US006474896B1

(12) United States Patent
DeLaine, Jr.

(10) Patent No.: US 6,474,896 B1
(45) Date of Patent: Nov. 5, 2002

(54) OSCILLATING AQUA BROOM

(76) Inventor: Phillip M. DeLaine, Jr., 28 Joco Dr., Tyngsboro, MA (US) 01879

( * ) Notice: Subject to any disclaimer, the term of this patent is extended or adjusted under 35 U.S.C. 154(b) by 0 days.

(21) Appl. No.: 09/617,729

(22) Filed: Jul. 14, 2000

Related U.S. Application Data

(63) Continuation-in-part of application No. 09/205,747, filed on Dec. 4, 1998.

(60) Provisional application No. 60/143,986, filed on Jul. 15, 1999, and provisional application No. 60/093,321, filed on Jul. 20, 1998.

(51) Int. Cl.[7] ..... A46B 11/06

(52) U.S. Cl. ..... 401/289; 401/137; 401/138; 401/285

(58) Field of Search ..... 401/137, 138, 401/285, 289, 284, 291, 268, 270, 271, 275, 282, 283, 286, 287, 288; 239/754, 225.1, 237, 239, 240, 242, 380, 289

(56) References Cited

U.S. PATENT DOCUMENTS

| | | | | |
|---|---|---|---|---|
| 539,313 A | * | 5/1895 | Thierry et al. | 401/284 |
| 590,871 A | * | 9/1897 | Abrell | 239/240 |
| 2,289,889 A | * | 7/1942 | Stick et al. | |
| 2,595,933 A | * | 5/1952 | Gilbertsen | |
| 2,692,163 A | * | 10/1954 | Geel | |
| 2,841,229 A | * | 7/1958 | Guise | |

(List continued on next page.)

FOREIGN PATENT DOCUMENTS

| | | | |
|---|---|---|---|
| DE | 77 36 700 | 4/1978 | |
| DE | 29717579 U1 * | 1/1998 | |
| DE | 298 07 640 U1 | 4/1998 | 13/26 |
| FR | 2 665 650 | 2/1992 | |
| GB | 485219 | 5/1938 | |
| GB | 677741 | 8/1952 | |
| GB | 940302 | 10/1963 | 47/1 |
| GB | 1 243 775 | 8/1971 | |
| GB | 2063714 A * | 6/1981 | |

OTHER PUBLICATIONS

International Search Report.

*Primary Examiner*—David J. Walczak
*Assistant Examiner*—Khoa Huynh
(74) *Attorney, Agent, or Firm*—Merchant & Gould

(57) ABSTRACT

A device for sweeping a substantially horizontal surface is provided which includes a broom having a handle and a head, a valve disposed on the device, and a spray bar movably disposed on the head for directionally spraying a liquid that is supplied to the valve, wherein the valve regulates the pressure of liquid sprayed by the spray bar. The valve can be spring-loaded and/or hand-controlled. The device may include tubing between the valve and the spray bar, which tubing may be positioned internal to the handle or external to the handle. The handle may be used to convey liquid, such as that from a garden hose, from the valve to the spray bar. In an embodiment, the head may include water channels and the spray bar may be made integral to the head. The spray bar may oscillate and may take a variety of shapes, including elliptical, u-shaped and straight shapes. The device may further include a reservoir for holding an agent for treating the horizontal surface.

3 Claims, 22 Drawing Sheets

U.S. PATENT DOCUMENTS 2,908,445 A 10/1959 Schwartz et al. ..... 239/317
3,110,055 A * 11/1963 Merrill ..... 401/137
3,113,335 A * 12/1963 Baicker ..... 401/139
3,150,394 A * 9/1964 Sauers
3,377,123 A * 4/1968 Leeson ..... 401/138
3,608,828 A * 9/1971 Tokar ..... 239/240
3,652,014 A * 3/1972 Neville
3,806,261 A 4/1974 Soultanian ..... 401/42
3,832,069 A * 8/1974 Petsch ..... 401/289
3,927,434 A * 12/1975 Burgess
3,931,931 A * 1/1976 Otis
4,095,746 A * 6/1978 Anderberg et al.
4,200,236 A 4/1980 Briar ..... 239/532
4,335,853 A * 6/1982 Szemeredi et al. ..... 239/239
4,552,476 A * 11/1985 Heraty et al. ..... 401/289
4,575,270 A 3/1986 Hammond ..... 401/40
4,895,179 A 1/1990 Hart ..... 134/172
4,930,699 A * 6/1990 Wall
5,888,006 A * 3/1999 Ping et al. ..... 401/138
5,988,912 A * 11/1999 Chen ..... 401/137

* cited by examiner

OSCILLATING AQUA BROOM

RELATED U.S. APPLICATION(s)

This invention claims priority to U.S. Application Serial No. 60/143,986, filed Jul. 15, 1999. This application is also a continuation-in-part of U.S. application Ser. No. 09/205,747, filed Dec. 4, 1998, which application claims priority to U.S. Application Serial No. 60/093,321, filed Jul. 20, 1998. All of these applications are hereby incorporated herein by reference.

FIELD OF THE INVENTION

This application relates to the field of cleaning implements, and more particularly to the field of brooms.

DESCRIPTION OF RELATED ART

A conventional push broom is a device that is commonly used to clean floors. Such a push broom is shown in FIG. 1. The components of push broom may include a broom handle 1 and a broom head 3 with attached bristles 2. The cleaning action of the broom is provided by the user exerting a downward force on the handle 1 while pushing forward, which causes the bristles 2 attached to the broom head 3 to push loose debris on a surface, such as a floor, to another location. The user then lifts the broom head 3 slightly and pulls backward, such that the broom head 3 is repositioned to repeat the cleaning action.

With a conventional push broom it usually takes several passes of the broom head to completely clean an area. For example, when attempting to sweep grass clippings off a concrete or asphalt surface, often the clippings partially adhere to the surface, which causes a rolling effect under the bristles as the bristles attempt to push the clippings away. The result is many of the clippings remain in the area just swept, which in turn requires the user to repeat the sweeping action in the same area several times in order to remove all of the debris. The need for such repetition can also be observed when sweeping sand, dirt or small rocks on a similar surface. Nevertheless, the conventional push broom is a device that is most commonly used to clean floors or other similar surfaces.

Debris can be removed from a floor surface by water pressure exerted by a hose nozzle attached to a common garden hose. An example of such a hose nozzle is illustrated in FIG. 11. The hose nozzle is a hand held device and, when activated while pointed at the floor, requires several horizontal and vertical motions in order to remove debris. With this method a significant amount of time and effort required to clean a large area. This method of cleaning can be ineffective if the debris content is high, partially stuck to the floor, relatively large or relatively heavy. In addition, the remaining water on the floor surface may cause puddling and require excessively long drying times.

Wheel-mounted spray systems are also known. These devices are generally called water brooms. An example of such a broom is shown in FIG. 12. This type of device uses the force of water to lift and push debris. Given the spray jets' close proximity to the floor, these devices can be effective when attempting to remove loose and relatively small debris from a floor. However, if the debris is larger or heavier, several cleaning passes may be required. When using this system, an area can be swept faster than the hose nozzle method mentioned above. However, 1) with normal household water pressures of 40 to 60 PSI these devices may be marginally effective in removing larger stones, gravel and other similar debris, 2) with normal water pressure, these devices may have limited abrasive cleaning characteristics, and mechanical pushing ability, 3) a pressure boosting device may be required in order to achieve the desired cleaning effectiveness, 4) with higher water pressures, the high misting effect can damage surfaces such as drywall in garages, 5) the cleaning action is provided only by the force of water which may be inappropriate in certain areas of a floor, 6) the water and debris on the floor can only be moved and directed with the spray of additional water, 7) as water pools in front of the device the pushing effectiveness of the water spray diminishes, thus allowing water and debris to flow around and behind the device, 8) higher amounts of water are required in order to clean a given surface, 9) the floor surface can remain very wet after use, 10) significant puddling can occur after use, 11) the floor drying time may be excessive due to the high amount of water remaining on the floor, 12) the remaining water on the floor may need to be removed by a push broom or squeegee, and 13) the corrosive effects of water, salt and grime, will cause the wheels or castors to deteriorate and become inoperable over time.

The water broom and similar devices are documented in several United States patents, the disclosures of which are incorporated by reference herein, including U.S. Pat. Nos. 3,931,931, 4,022,382, 4,083,495, 4,095,746, 4,930,706, Des. 243,610, Des. 244,532, Des. 250,826, and Des. 277,499.

FIG. 13 shows an example of a device which combines brush and water technology. Pictured is a model 8540 cleaning device manufactured by Mr. LongArm, Inc. This device features a water cut-off turn valve 100, with an exploded view 101, and a brush head 104, with an exploded view of the bottom 105. This device also features an extendable broom handle 102 which is adjusted at 103.

FIG. 15 shows a flow chart that lists the procedures for the brush device's use. Referring to FIGS. 13 and 15, and starting at step 130, the user connects a garden hose to the water service and the brush device at 100. The user checks that the water cut-off valve 101 is turned off, at step 131. The user turns on the water service, at step 132. While holding the broom handle 102, the user positions the brush head 104 near the surface to be cleaned, at step 133. At step 134, the user turns the valve control 101 such that water passes through the valve 101, the broom handle 102 and emerges from a hole 107 at the bottom of the brush head 105. The user pushes the brush head 104 onto the surface to be cleaned, at step 135. At step 136, the user induces a back and forth action on the broom handle 102 such that the brush head 104 scrubs the desired surface. At step 137, if additional cleaning is required, step 136 is repeated. If not, at step 138, the user removes the brush head 104 from the surface, turns off the water cut-off valve 101 and stops. This device may be useful when cleaning surfaces such as walls, vinyl siding, cars, tires and other sloping or substantially vertical surfaces. The general release of water near the brush bristles and the scrubbing action is very effective for these surfaces. The issue of where the water goes is generally not a problem because the water falls and drips off the item being cleaned. However, this type of device may not be appropriate for cleaning floors or other similar horizontal surfaces. When used on a floor, the water emerges on the floor in an arbitrary manner. There is no directional control of the water from the brush head, which makes this device difficult to use in floor sweeping applications. In addition, the lack of easy control of the water flow at the cut-off valve may add another layer of difficulty and complexity to the operation on such surfaces. This type of device may simply not be practical for sweeping floors. Other examples of this art can be found in patents including Russell, British Patent 485,219, accepted May 17, 1938, Schwartz, U.S. Pat. No. 2,908,445, issued Oct. 13, 1959, Brown, British Patent 1,243,775, published Aug. 25, 1971, and Hammond, U.S. Pat. No. 4,575,270, issued Mar. 11, 1986. Cohen, British Patent 677,741, published Aug. 20, 1952, Soultanian, U.S. Pat. No. 3,806,261, issued Apr. 23, 1974, and Diaz, U.S. Design Patent Des. 404,923, issued Feb. 2, 1999 teach a water brush for cleaning floors.

Accordingly, a need exists for a device that overcomes the drawbacks of the devices described above and that is practical for sweeping floors and other horizontal surfaces.

SUMMARY OF THE INVENTION

The invention herein provides a unique, highly effective, practical and easy to use and assemble floor sweeping system.

Provided herein is a device for sweeping a substantially horizontal surface, which includes a broom having a handle and a head, a valve disposed on the device, and a spray bar disposed on the head for directionally spraying a liquid that is supplied to the valve, wherein the valve regulates the pressure of liquid sprayed by the spray bar. The liquid may be water from a common garden hose. In embodiments, the spray bar is movably positioned on the head. In embodiments, the device may further include a reservoir for holding an agent for treating the horizontal surface. The treating agent may be a soap, a solvent, a stain, a cleaning liquid, a paint, a wax, or any other known treating agent. The device may include a filter for filtering particles from the treating agent. In embodiments, the valve is springloaded and/or hand-controlled. The device may include tubing between the valve and the spray bar. The tubing may be positioned internal to the handle or external to the handle. The handle may be used to convey liquid from the valve to the spray bar. In an embodiment, the head may include water channels. The spray bar may be made integral to the head. The spray bar may take a variety of shapes, including elliptical, u-shaped and straight shapes.

Provided herein is also a method of using a device for cleaning a substantially horizontal surface, including providing a broom having a handle and a head, positioning a valve on the handle, positioning a spray bar on the head for spraying a liquid that is supplied to the valve, providing a supply of cleaning liquid to the valve, opening the valve and sweeping the surface with the broom while spraying the surface with the spray bar. The methods may include adjusting the position of the spray bar according to the nature of the cleaning task.

Provided herein is further a device for sweeping a substantially horizontal surface, which may include a broom having a handle and a head, a spring-loaded, hand-controlled valve disposed on the handle, a spray bar disposed on the head for directionally spraying a liquid that is supplied to the valve, wherein the valve regulates the pressure of liquid sprayed by the spray bar and wherein the spray bar is movably positioned on the head, and a tube, having a lumen, for delivering the liquid from the valve to the spray bar. The device may further include a reservoir for holding an agent for treating the horizontal surface. The tube may be positioned internal to the handle. The head may include water channels. The spray bar may be made integral to the head.

In an embodiment of the invention, an oscillating spray bar provided, which may improve the performance of the device in some circumstances.

DETAILED DESCRIPTION OF SPECIFIC EMBODIMENT(S)

Figure 1:
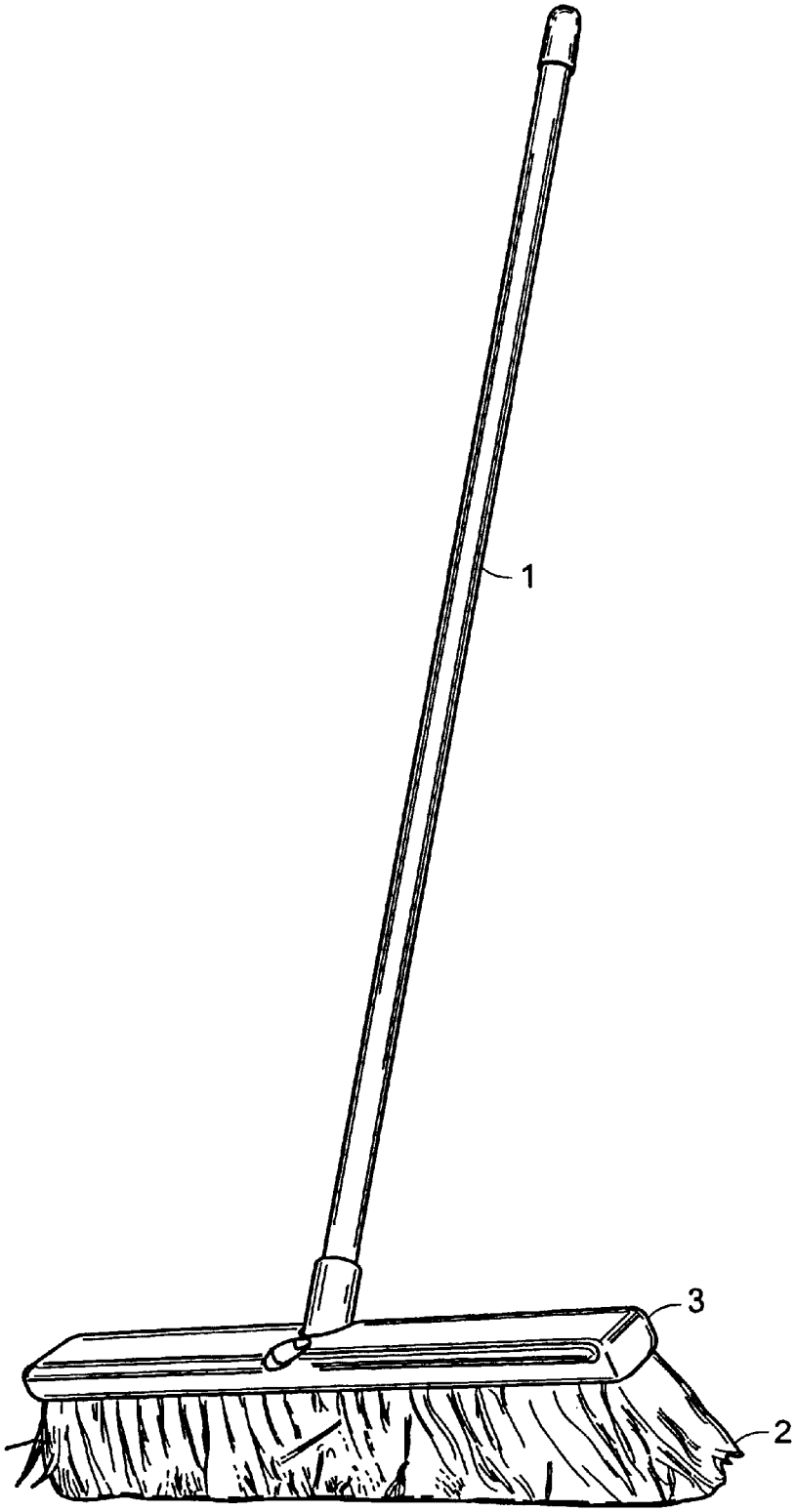
FIG. 1 depicts a conventional push broom.
Figure 2:
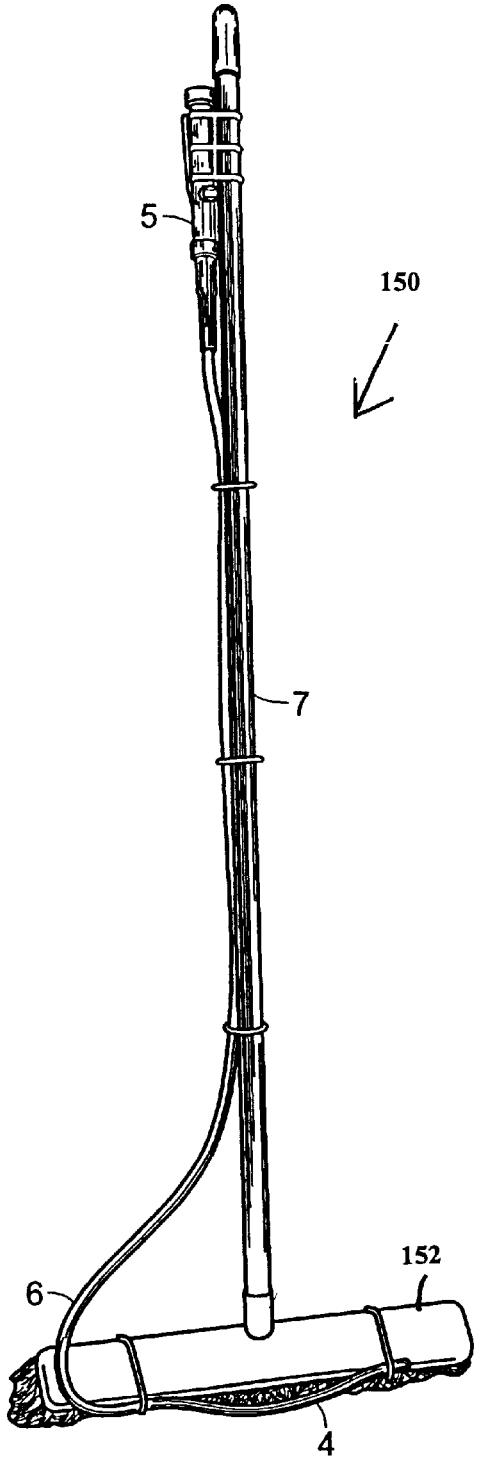
FIG. 2 depicts an embodiment of the invention, including a water spray bar and a spring-loaded hand-controlled valve.
Figure 3:
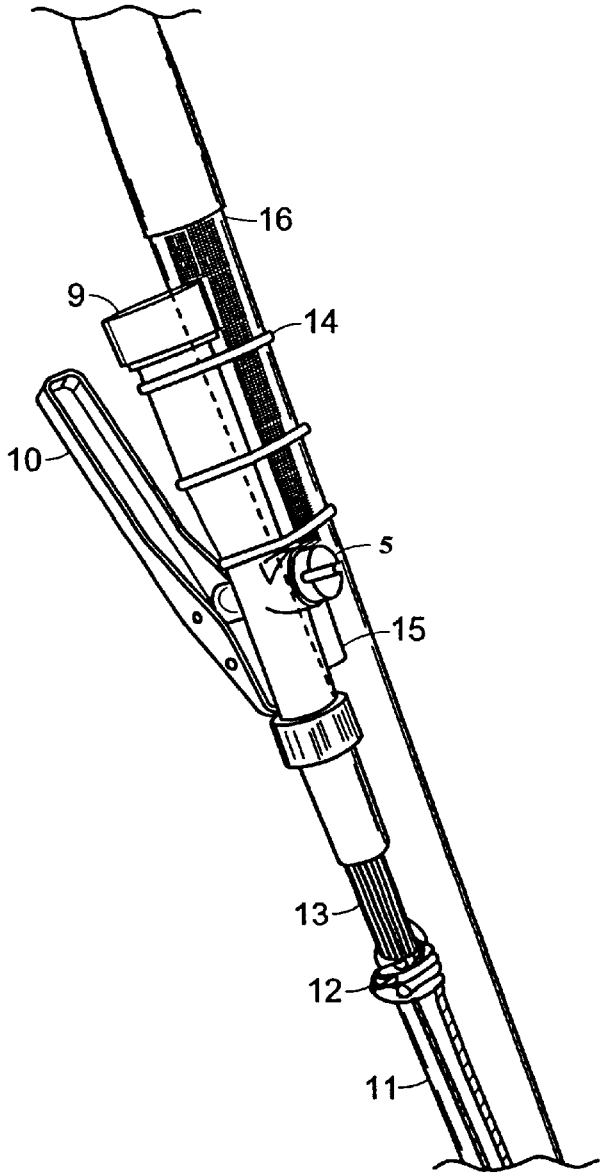
FIG. 3 depicts a detailed view of the valve assembly of the embodiment of FIG. 2.

Referring now to FIGS. 2–3, the present invention provides herein, in accordance with one embodiment, a push broom 150 having a broom head 152, a handle 7, a water spray bar 4 and a spring-loaded hand-controlled valve 5, as shown in FIG. 2. A common garden hose is connected to the spring-loaded valve 5 at a valve entry point 9, shown in FIG. 3. The valve 5 may be used to regulate the flow of water from the hose to a spray bar 4. Referring again to FIG. 2, the water may be conducted from the valve 5 to the spray bar 4 via tubing 6. When the user squeezes a valve lever 10 toward the body of the valve 5, water is enabled through the valve 5 and tubing 6 to the spray bar 4. When the user releases the valve lever 10, the valve 5 is closed, which stops the water flow to the spray bar 26.

Figure 4:
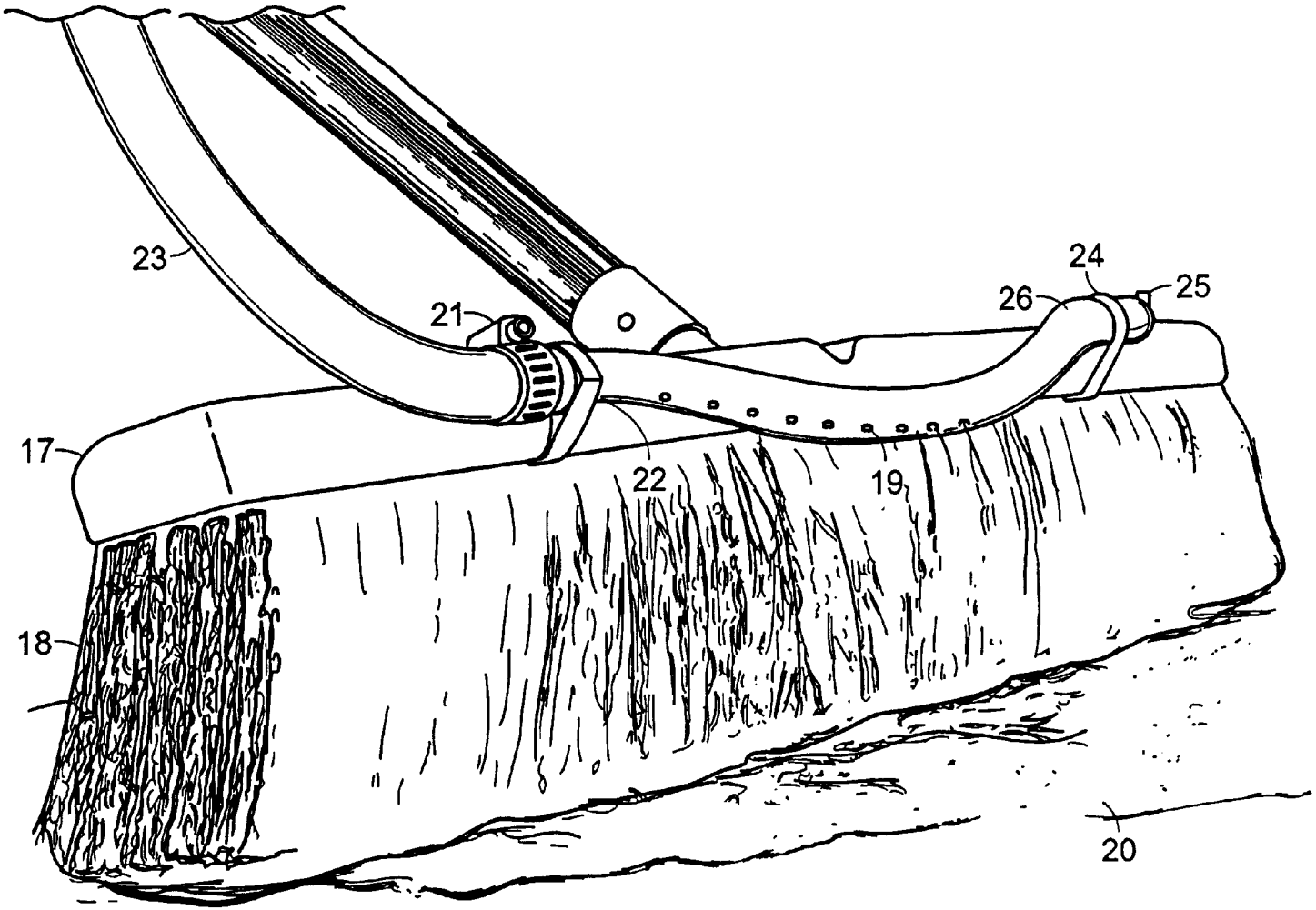
FIG. 4 depicts a detailed view of the water spray bar of the embodiment of FIG. 2.

Referring to FIG. 4, spray bar 26 contains several holes 19 and is positioned in front of the broom head 17 such that when water pressure is applied, strong jets of water emerge from the holes 19, which pound and buffet a surface 20, such as a floor surface, in front of bristles 18 of the broom head 17.

The push broom is provided with a directional water jet spray from the spray bar 26, for dislodging and suspending debris prior to the sweeping action of the broom's bristles 18. Most, if not all, of the debris can be removed with a single sweeping pass.

Figure 14:
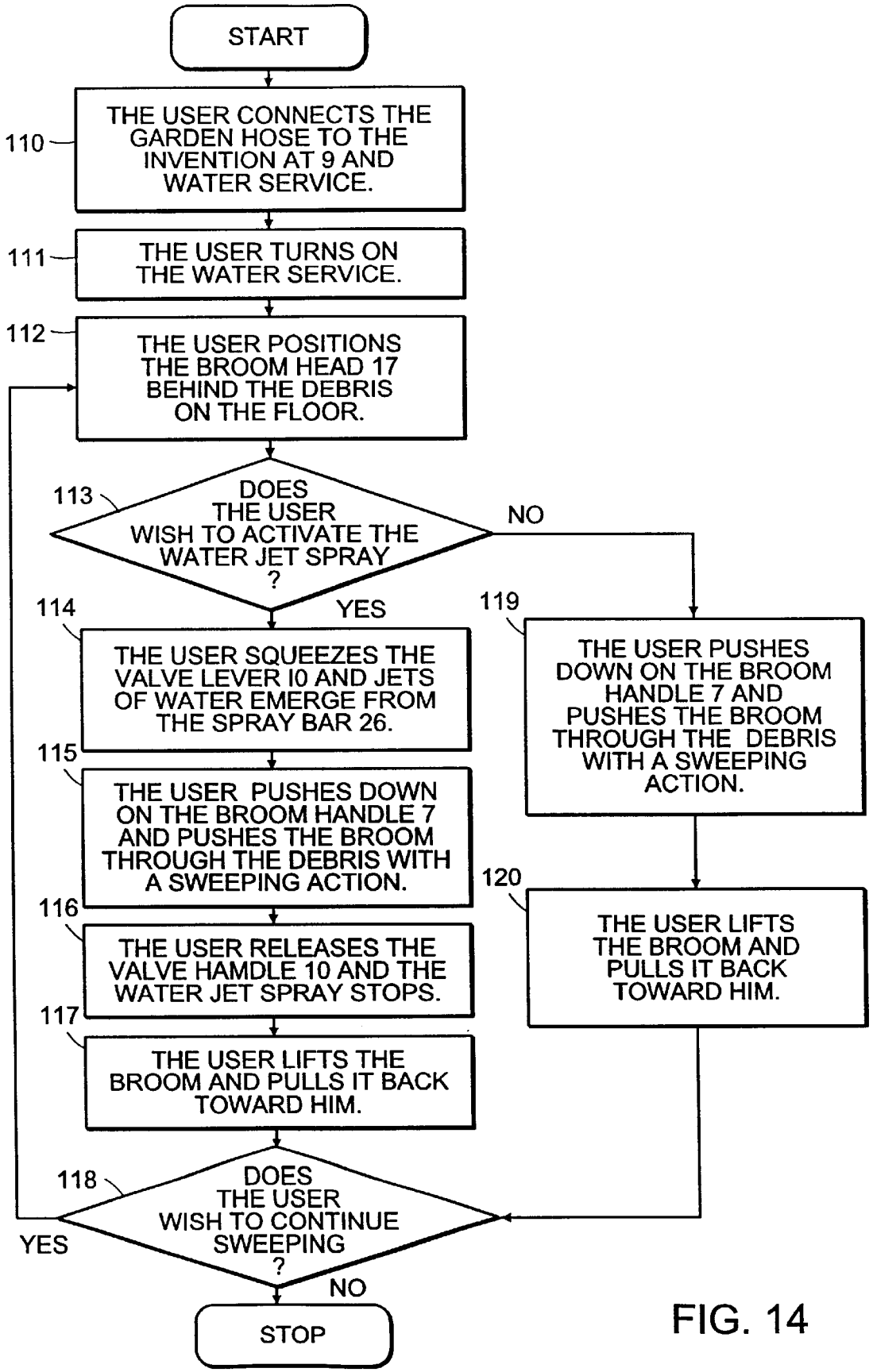
FIG. 14 is a flow chart that lists the procedures for use of an embodiment of the invention.
Figure 15:
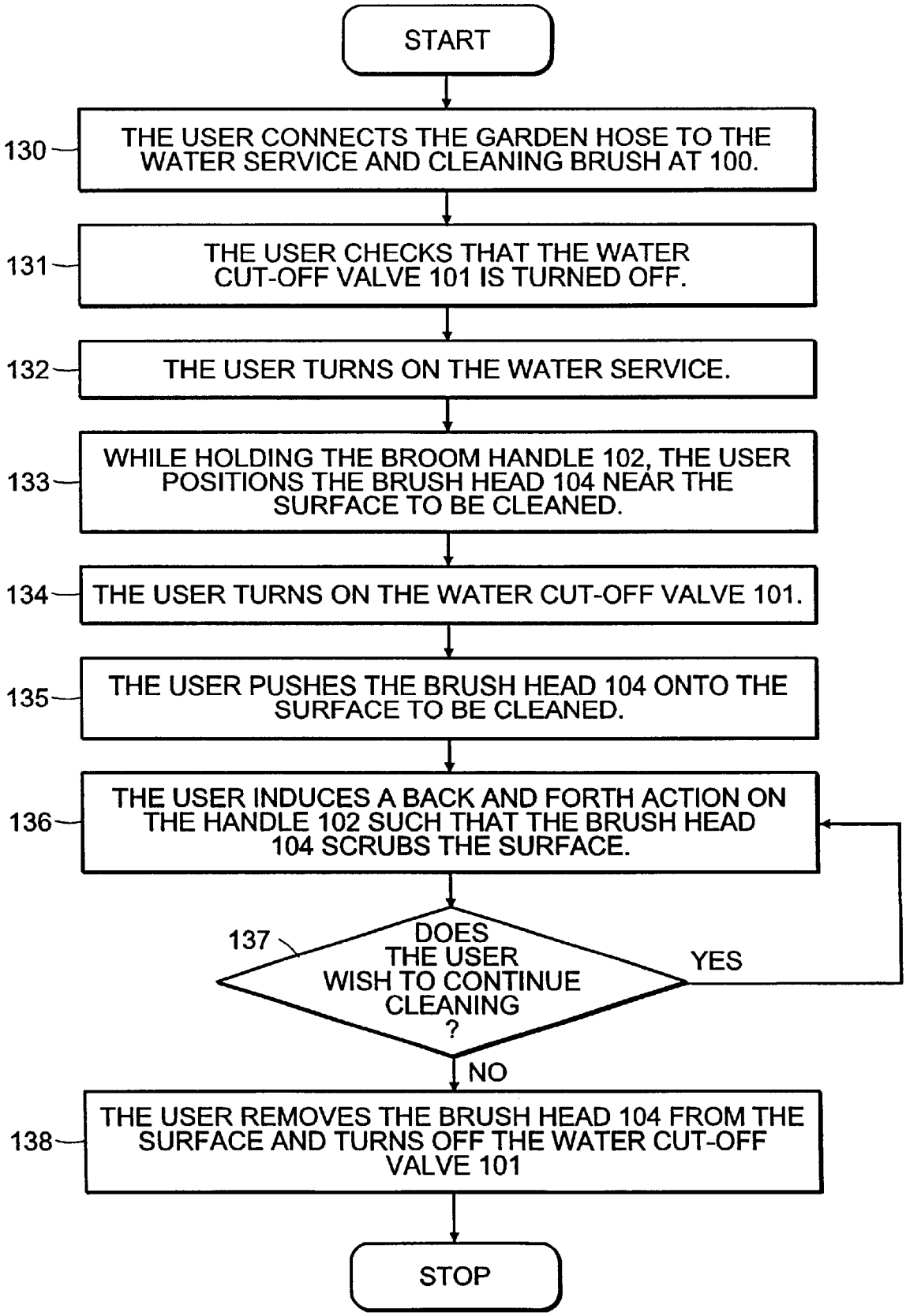
FIG. 15 is a flow chart that lists the procedures for the use of a conventional brush device.

FIG. 14 shows a flow chart that lists the procedures for the invention's use. Referring to FIG. 14 and starting at step 110, the user connects the garden hose to the invention at the valve entry point 9 and connects the hose to the water service. The user turns on the water service, at step 111. The user positions the broom head 17 behind the debris he or she wishes to move, at step 112. At step 113, the user decides whether or not to use to the water jet spray. At step 114, if the water jet spray is desired, the user squeezes the valve lever 10 and jets of water emerge from the spray bar 26. The user pushes downward on the broom handle 7 and pushes the broom through the debris area, at step 115. At the end of the user's extension, the user releases the valve lever 10 and the water jet spray stops, at step 116. The user lifts the broom, pulls the broom back toward him or her self, at step 117. At step 118, if the user needs to perform additional cleaning, the steps starting at step 112 can be repeated. If not, the user can stop. If at step 113 the user decides not to use the water jet spray, the user pushes downward on the broom handle 7 and pushes the broom through the debris area, at step 119. The user lifts the broom, pulls the broom back toward him or her self, at step 120. At step 118, if the user needs to perform additional cleaning, the steps starting at step 112 can be repeated. If not, the user can stop.

Figure 5:
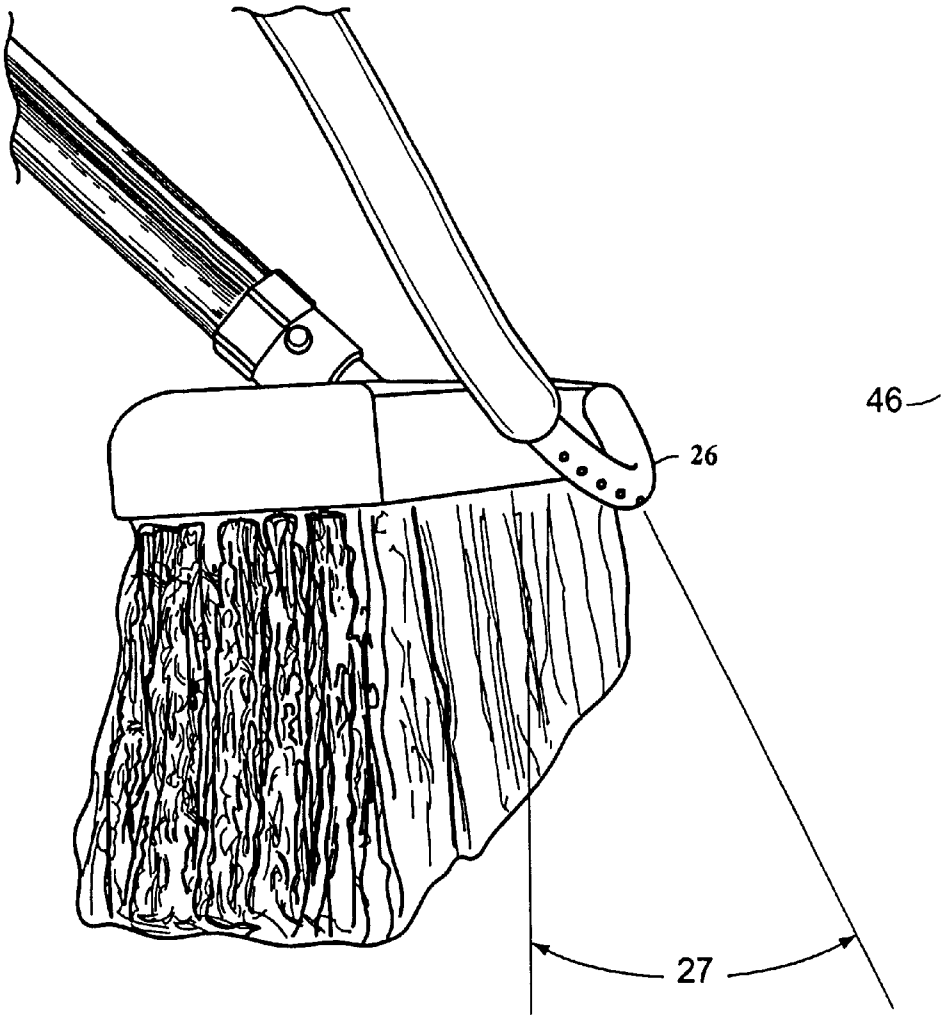
FIG. 5 illustrates the capability of changing the water spray attack angle by manually rotating the pitch of the spray bar.

Referring to FIG. 5, the broom of the present invention permits the user to change the water spray attack angle 27 on the floor by manually rotating the pitch of the spray bar 26. The ability to change the water attack angle 27 allows the user to match the effectiveness of the water jet spray with the type of debris that is being swept. Effective water attack angles may be in a wide variety of angles. In embodiment, water attack angles of between fifteen and forty-five degrees are available.

The broom of the present invention has significant cleaning flexibility. The broom easily removes sand, dirt, grime, grass clippings, pine needles, saw dust, bark mulch, small rocks and any other similar debris from a floor surface. The combined forces of the water jet spray and the highly abrasive characteristics of the broom bristles can also remove debris stuck to the floor. The broom can clean very contaminated areas due to the broom bristles which can collectively push large amounts of debris and water. This broom is ideal for cleaning concrete, asphalt, steel, plastic, wood or other horizontal surfaces. These surfaces include; garage and basement floors, patio decks, street curb areas, truck beds (plastic or steel), sidewalks and any other surface where a water jet spray and sweeping action would be effective.

The broom works extremely well with normal household water pressures from 40 to 60 psi. Higher water pressures can be used, and, in some applications, may be desirable.

The broom also serves the user excellent control over the amount of water used, and when not needed, the user can direct the water and/or debris with the broom bristle action alone. Because the broom bristles follow the water spray, the floor surfaces will only be damp and relatively quick to dry after the invention's use.

The broom, as shown in FIGS. 3–5, may be constructed, in accordance with one embodiment of the invention, with the following materials. The valve 5 may be fabricated from a Sears Telescoping Shower Sprinkler, ID number $^{71}$69081. The spray bar 26 may be a Nelson model 1015 Rainshower® oscillator sprinkler. The spray bar 26 may be an aluminum, elliptically shaped ½" diameter tube, 11⅝" long, with a plurality of spray jets spaced approximately ½" apart. A band saw may be used to cut the Shower Sprinkler and Oscillator sprinkler so as to isolate the valve 5 and the spray bar 26, respectively. Both devices may be cut in a location allowing sufficient stems 13, 22 so that vinyl tubing and clamps 12, 21 can be attached. In addition, the elliptical sprinkler tube may include a plug 25 to prevent water from exiting the end of the sprinkler tube. With the plug removed, water under pressure can be used to flush the tube free of jet clogging debris. The broom may be similar to that manufactured by O-Ceder Brands with a 54" long broom handle and a broom head which measures approximately 17½" Wide×2 ½" Thick ×4" High. The height includes a bristle length of 3". The tubing 11, 6, 23 may be made of ordinary clear ⅝" outer diameter×½" inner diameter vinyl tubing with a length sufficient to reach from the valve stem 13 to the spray bar stem 22, and the strength to withstand water pressure. The device may include straps 14, 24, which may be common ties made of plastic with sufficient strength to hold the various components in place. The clamps 12, 21 may be made of ordinary stainless steel sufficient to fix the vinyl tubing onto the valve stem 13 and spray bar stem 22. A piece of wood 15, 4½" Long×¼" Wide×¾" High, may be used as a spacer that allows for proper seating of the valve 5 onto the broom handle 16.

Advanced manufacturing may allow different adaptations of the invention. The spring-loaded valve can be made to attach onto the broom handle via glue, screw, snap, clip, or clamp. The valve can be made as an integral part of the broom handle. The valve can be located on the broom head or another part of the handle. The spring-loaded valve can be made to actuate by a button, trigger or lever type mechanism. The valve can also be made to actuate by a mechanism that senses the downward or pushing force on the broom handle. The tubing can be placed inside of a hollow broom handle. The broom handle can be manufactured such that it passes the water from the valve to the broom head without vinyl or similar tubing. The broom head can be manufactured with water channels molded or built into the broom head. A broom head can be manufactured to reduce water from the broom handle and pass it to the spray bar without the need of vinyl or similar tubing. The broom head can be manufactured such that the spray bar is an integral part of the broom head. The spray bar can be made of aluminum, plastic or other material. The spray bar can be manufactured in different shapes including elliptical, u-shaped or straight.

The spray bar can be manufactured with varied lengths and number of spray jets. The spray bar can be manufactured to glue, screw, snap, clip, clamp or use some other means to attach to the broom head. The spray bar can be manufactured to swivel to different angles or be fixed to a particular angle. The spray jets can be manufactured with various diameters and shapes. The size and quantity of spray jets can be varied to maintain sufficient water pressure and force in front of the broom head. All of these adaptations, or similar adaptations, practice the invention herein.

All of the components, the valve, the tubing, the spray bar and the clamps can be manufactured such that they form a kit so that a user can change a common push broom into the invention. Assembly can be made significantly easier with the use of "Quick Connector" type connectors at the ends of the components. Quick Connector technology is taught by WaterWhiz, Inc's Lego products, and Nelson's "Snap Connect" under U.S. Pat. No. 4,856,823. For an integrated design, the valve, broom handle and broom head can also be manufactured as a kit and user assembled by screwing the components together.

Figure 6:
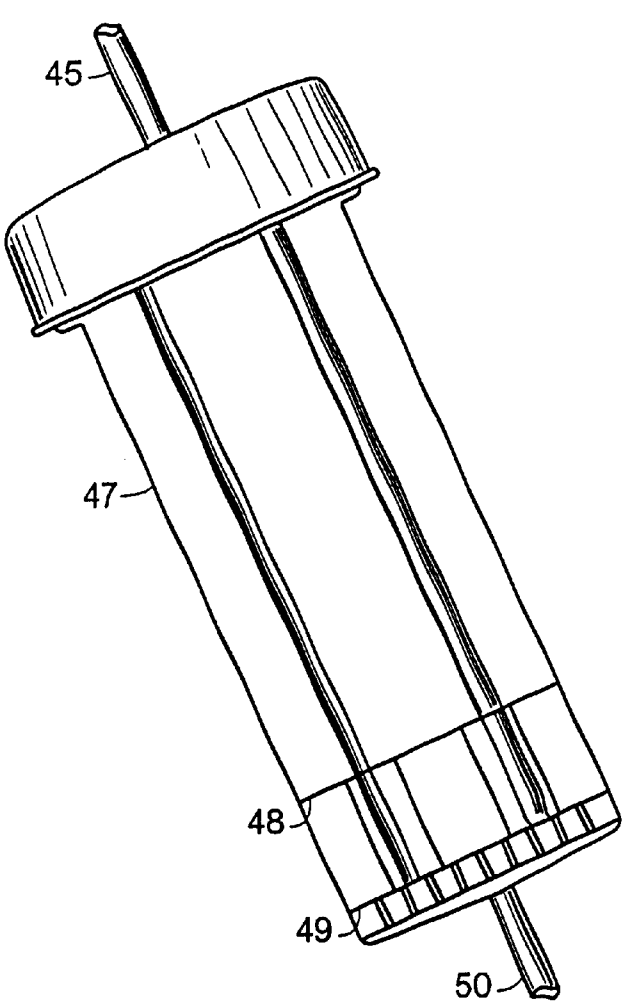
FIG. 6 illustrates a reservoir that can be positioned mid-handle or on the broom head in an embodiment of the invention.

FIG. 6 shows a reservoir 47 that can be positioned on the broom handle or on the broom head. This feature allows the user to dispense a soap and water solution that can then be scrubbed into a surface using the broom bristles. The turbulence of the water as it passes through the reservoir 47 can be used to dissolve the soap agent resting on top of a platform 48. Other agents can be used including a wax or stain. The agent can be in the form of tablets or granules. The agent can be made to dissolve slowly and with sufficient strength so that the user has sufficient effective spray time for the application. A screen filter 49 can be positioned at the bottom of the reservoir to prohibit small particles of agent from plugging the holes in the spray bar. The reservoir 47 may be opened or disassembled at 46 in order to fill it with the desired agent, and when closed or reassembled, a watertight compartment is formed that can withstand water pressure. The input stem 45 can be connected to the valve stem 13 via vinyl tubing. The output stem 50 can be connected to the spray bar 26 via vinyl tubing. Clamping as previously discussed can be used to attach the vinyl tubing to the stems. The reservoir may be fixed to the broom handle by clamp, straps, screws, nails or other attachment means or integrated into the handle or broom head. Integrated reservoir designs are more practical from manufacturing standpoint and offer greater flexibility and control of the applied agent. With these designs liquid agents are a better option and a button or other triggering method can be used to regulate the agent's application. The reservoir adds an additional cleaning feature while maintaining the simplicity of the invention.

Figure 7A:
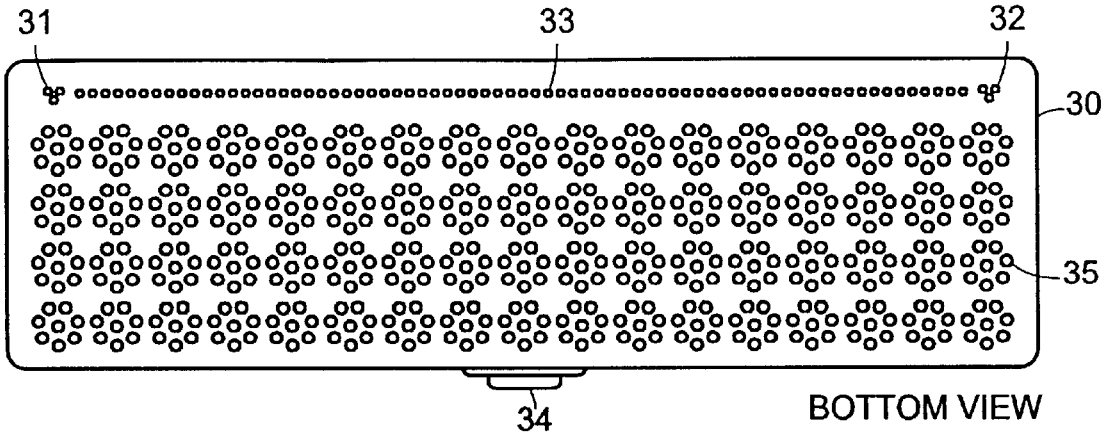
FIG. 7 depicts a bottom view of a broom head with an integrated spray bar.
Figure 7B:
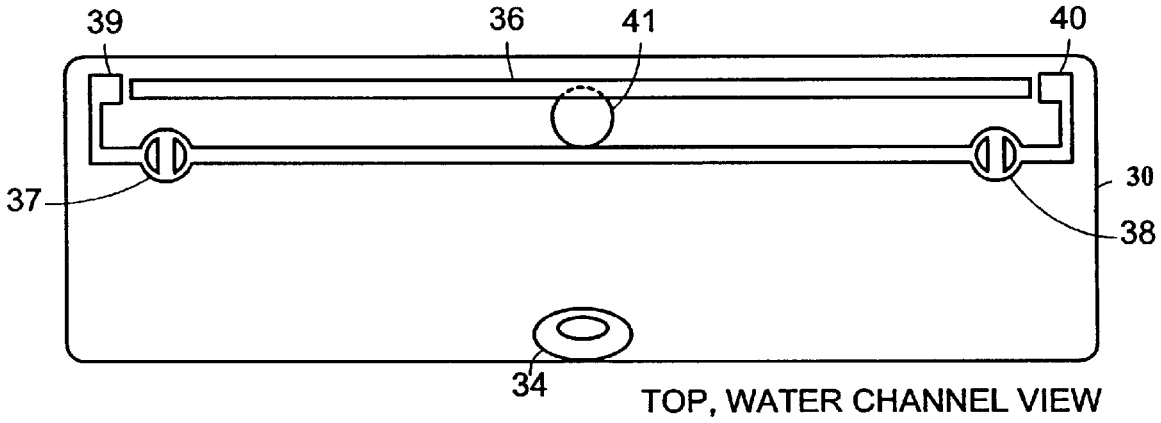
Figure 7C:
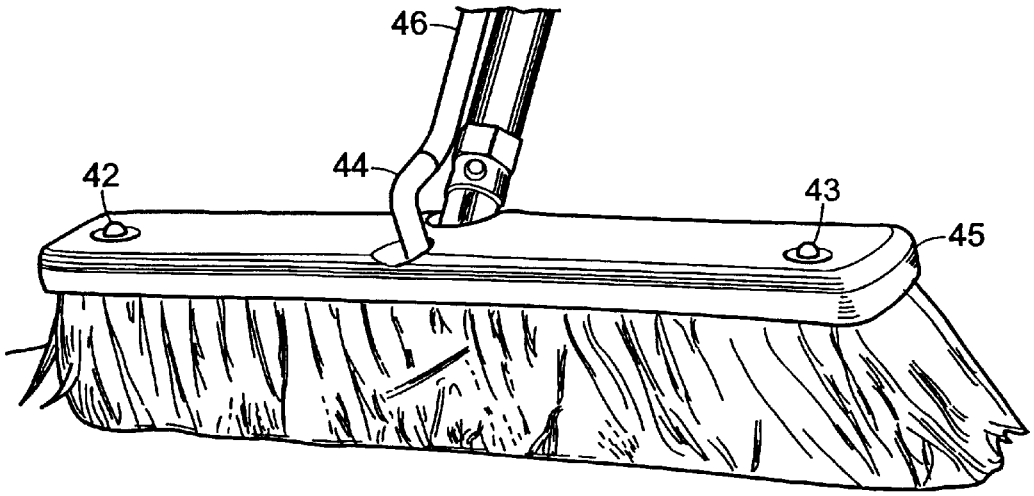

FIG. 7 shows a bottom view of a broom head 30, for example, an 18" wide broom head, with an integrated spray bar. The broom head 30 includes a spray bar 33 having a plurality of spray jets centered to the broom head 30 and evenly spaced, for instance, about 1" apart. The spray jets may include a hole with a diameter of approximately 3/64" and may be angled at about 35-degrees. The broom head 30, in this design, may include two integrated turn valves 37 and 38 which control left and right edge water spray jets 31 and 32, respectively. The turn valves 37 and 38 can be manually actuated by the user with twist knobs 42 and 43 located on top of the broom head 45. The edge spray jets 31 and 32 discharge a focused volume of water from the edges of the broom head 30. The edge water spray jets are extremely effective and useful when cleaning surfaces next to walls, curbs or other vertical constructions. (For reference, the broom handle attachment point 34 is shown.) All of the spray jets are shown on the bottom of the broom head; however, alternatively, they can be positioned on the front of the head.

FIG. 7 also shows a top view of the broom head 30 indicating the location of the water channels 36, 39, 40 which supply jets 33, 31 and 32, respectively. A stem tube 44 receives water from a vinyl tube 46 and supplies the water to the water channels at 41.

Figure 8A:
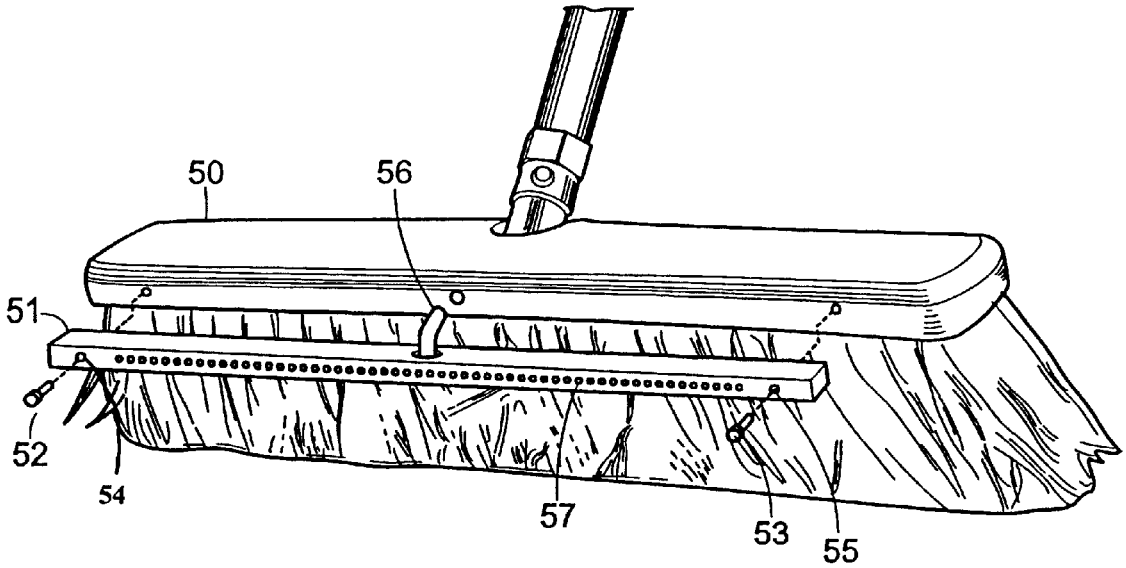
FIG. 8A shows an embodiment of the invention with an alternative spray bar design.

FIG. 8A shows another spray bar design for broom head 50. The broom head may include spray bar 51 made from, for example, a ½" square tube having a length of about 16". The spray bar 51 may be attached to the broom head 50 where indicated via screws, nails or other attachment means 52 and 53, at 54 and 55 respectively. The spray bar 51 may include a plurality of spray jets 57 centered on the spray bar 51 and evenly spaced, for instance, about ¾" apart. The spray jets 57 can be positioned on the bottom or front of the spray bar 51. The spray jets have a hole diameter of approximately 3/64" and are angled at 35-degrees. Vinyl tubing from the valve can be attached at 56.

Figure 8B:
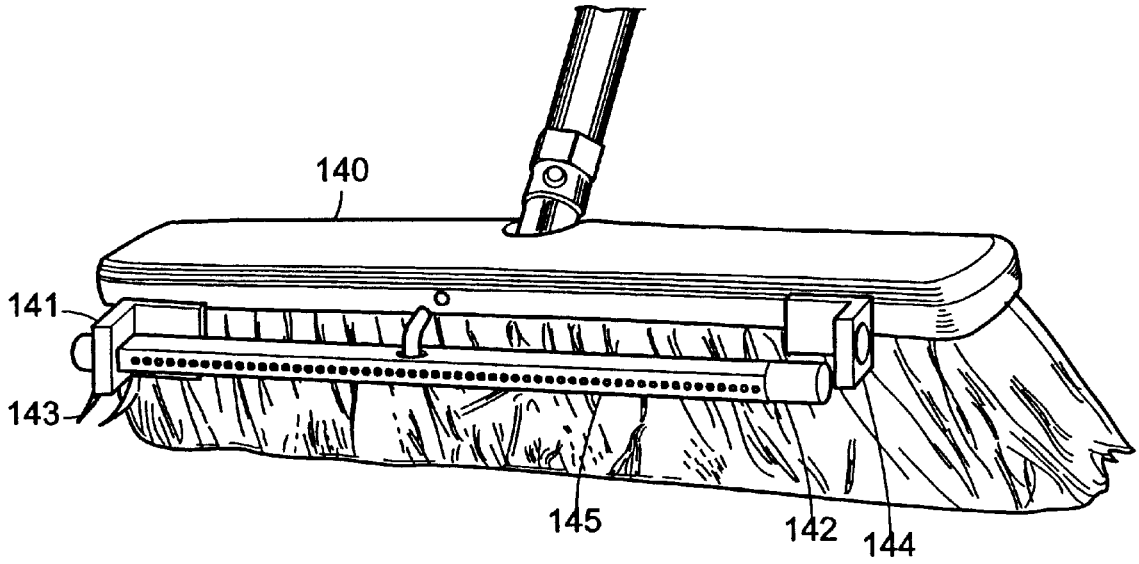
FIG. 8B shows an embodiment of the invention with another alternative spray bar design, including attachment of the spray bar with brackets.

FIG. 8B shows a similar spray bar design as above, except that spray bar 145 is attached to broom head 140 via brackets 143 and 144. The spray bar 145, as shown in FIG. 8B, includes rounded ends 141 and 142, which ends may be placed through holes in brackets 143 and 144, respectively. The brackets are attached to the broom head 140 where indicated. The brackets 143 and 144 could be a molded on the front or bottom front of broom head 140. The bracket 143 and 144 are made such that the spray bar 145 may be held firmly within the holes. The advantage means design is that it allows the user to change the pitch of the water jet spray by manually rotating the spray bar 145. This design also shows slotted water spray jets 146. The slotted jets 146 help spread the water force horizontally and more uniformly in front of the broom head 140. The slotted spray jets 146 can be positioned on the bottom or front of the spray bar 145. The size and quantity of slotted spray jets should be sufficient to maintain adequate water pressure and force in front of the broom head 140. The use of slots, holes or other shapes of water jets practice the invention herein.

Figure 9A:
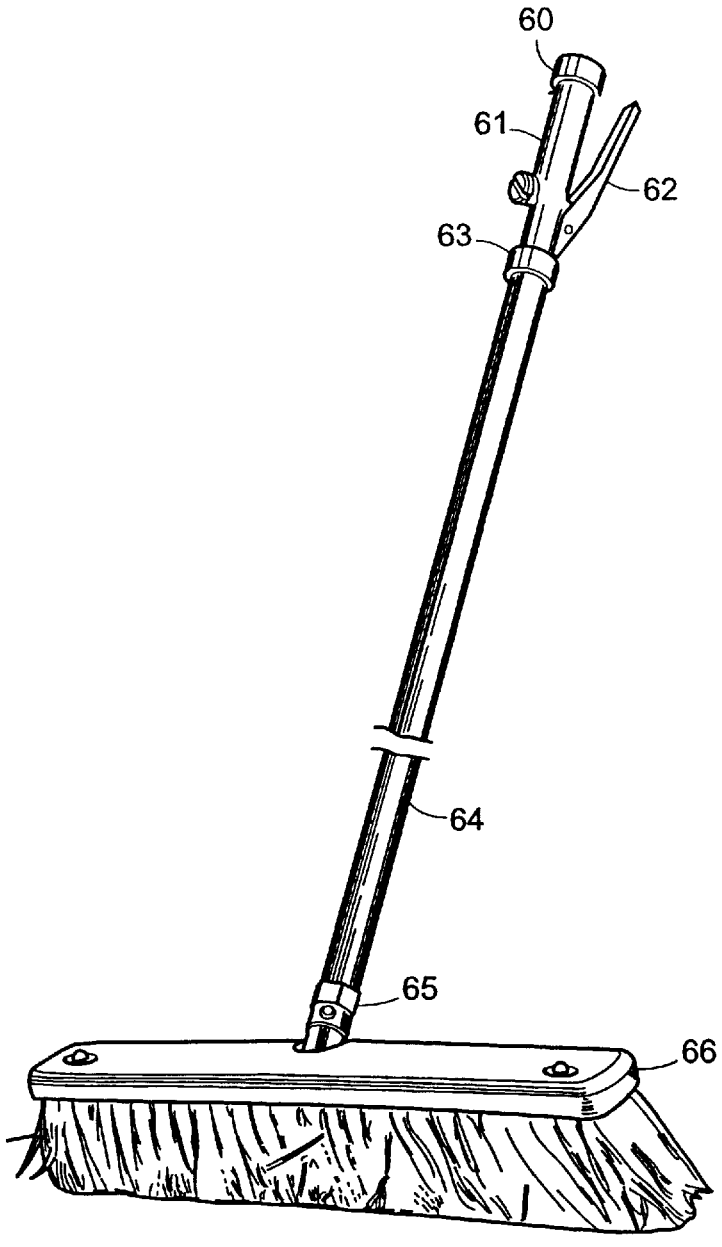
FIG. 9 shows an embodiment of the invention with a valve integrated onto a hollow broom handle.
Figure 9B:
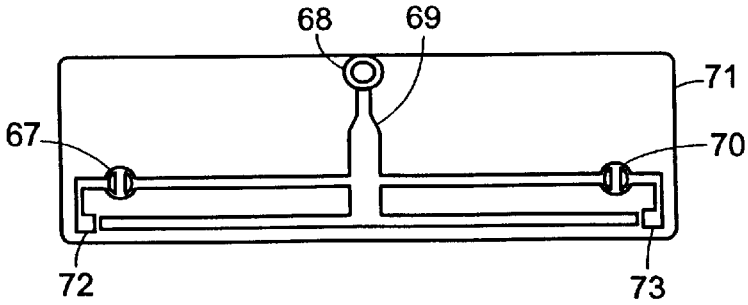
Figure 9C:
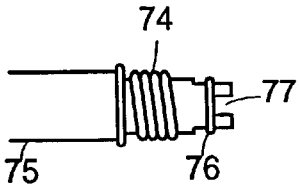

FIG. 9 shows, in accordance with one embodiment of the invention, a valve 61 integrated onto a hollow broom handle 64. With this design no external tubing is required. A water hose may be connected at 60 and the water may be regulated via spring-loaded valve 61. When lever 62 is squeezed toward the valve 61, water passes through the valve and into the hollow broom handle 64. The broom handle 64 screws into broom head 66 at 65. The top water channel view 71 also shows where the broom handle end 74 attaches to the broom head at 68. Water may be supplied from the broom handle 64 and 75 through the broom handle end hole 77 to the broom head water channel 69. A rubber o-ring type washer 76 seats inside of the broom handle attachment point 68 such that water, under pressure, can pass from the broom handle 64 to the broom head water channel 69 without leaking. The bottom view of the broom head can be identical to 30 in FIG. 7 as previously described. The edge water spray jets, if so equipped, can also operated as previously described.

Figure 10A:
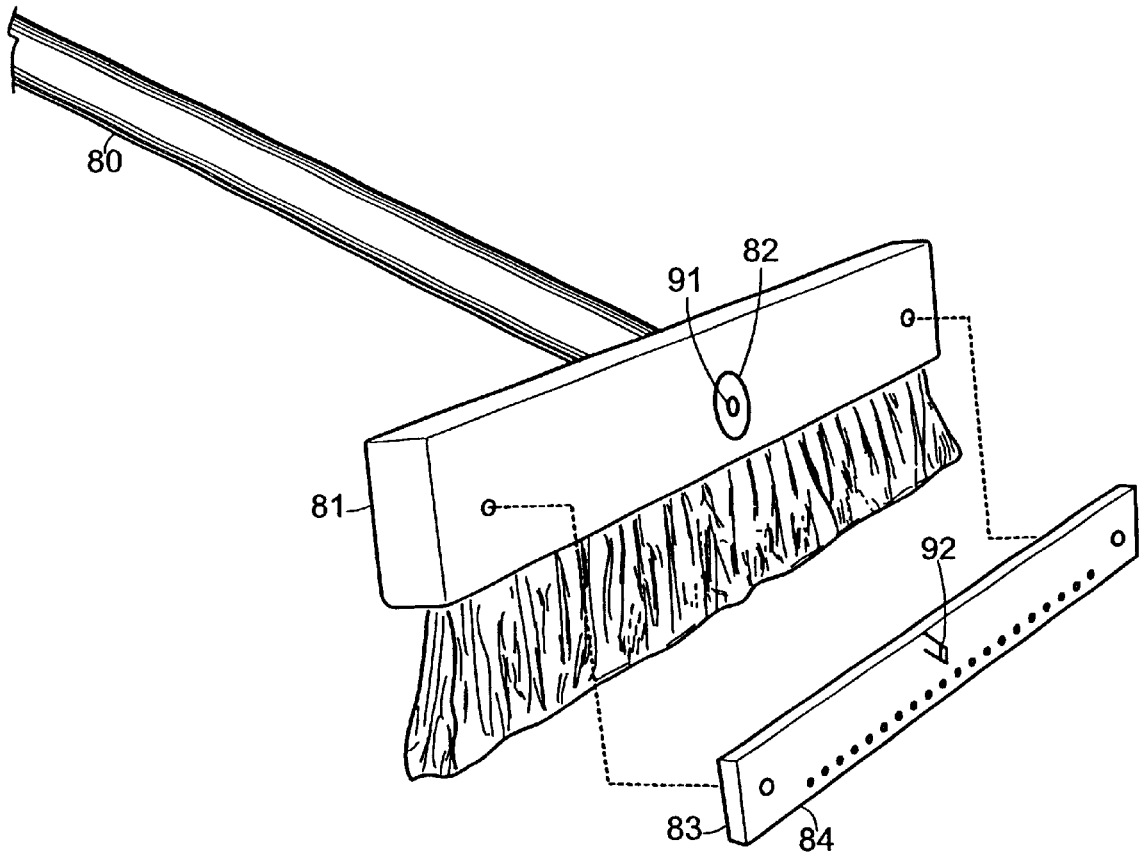
FIG. 10 shows an embodiment of the invention with a cost-effective broom head design.
Figure 10B:
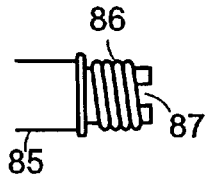
Figure 10C:
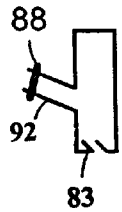
Figure 11:
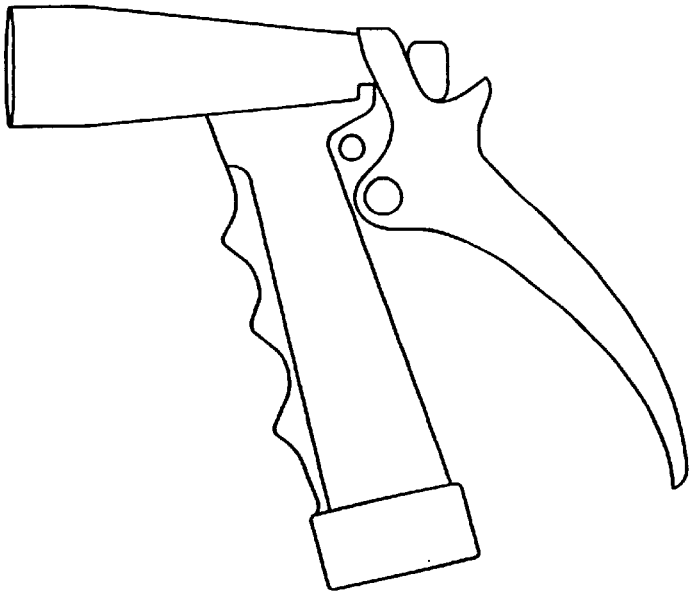
FIG. 11 shows an example of a hose nozzle.
Figure 12:
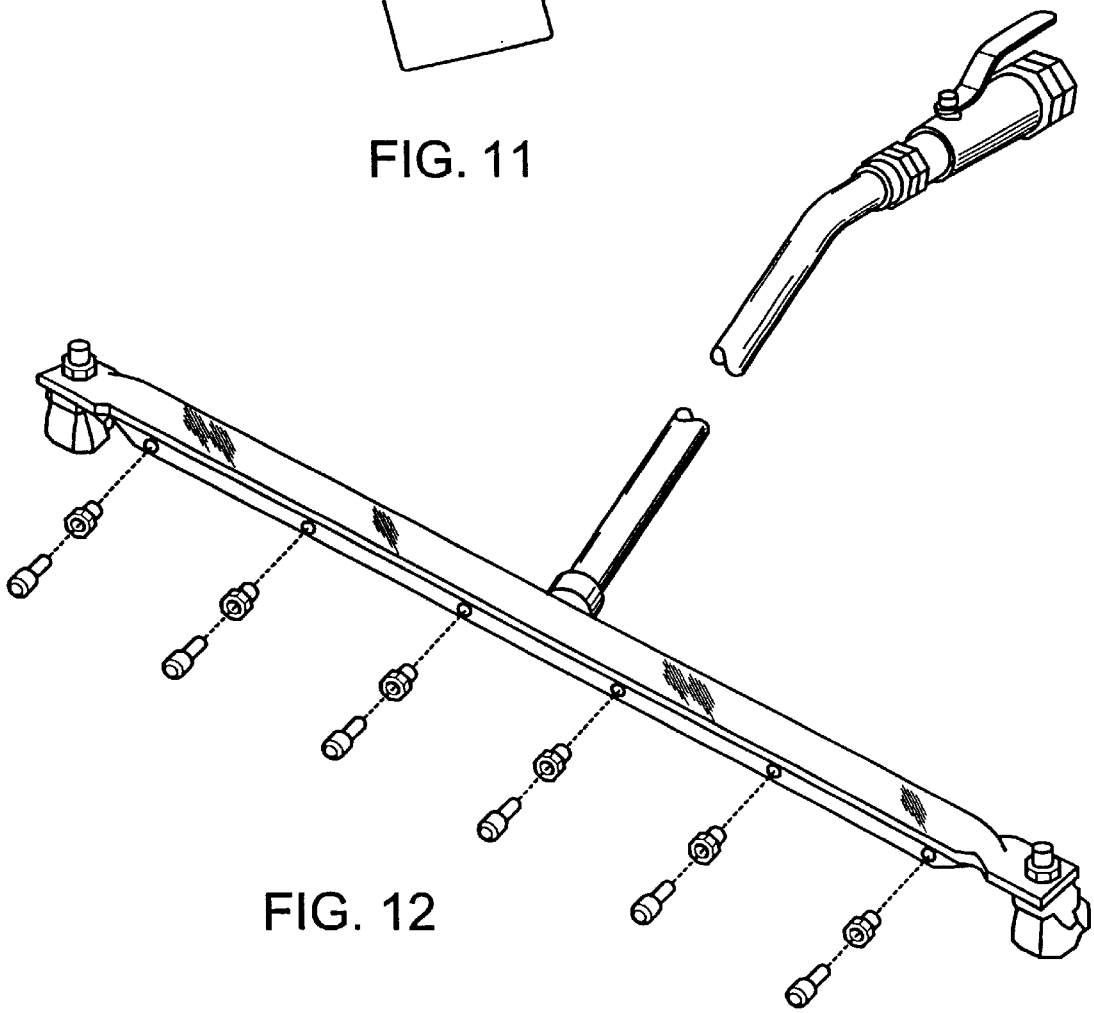
FIG. 12 depicts a conventional wheel-mounted spray system.
Figure 13:
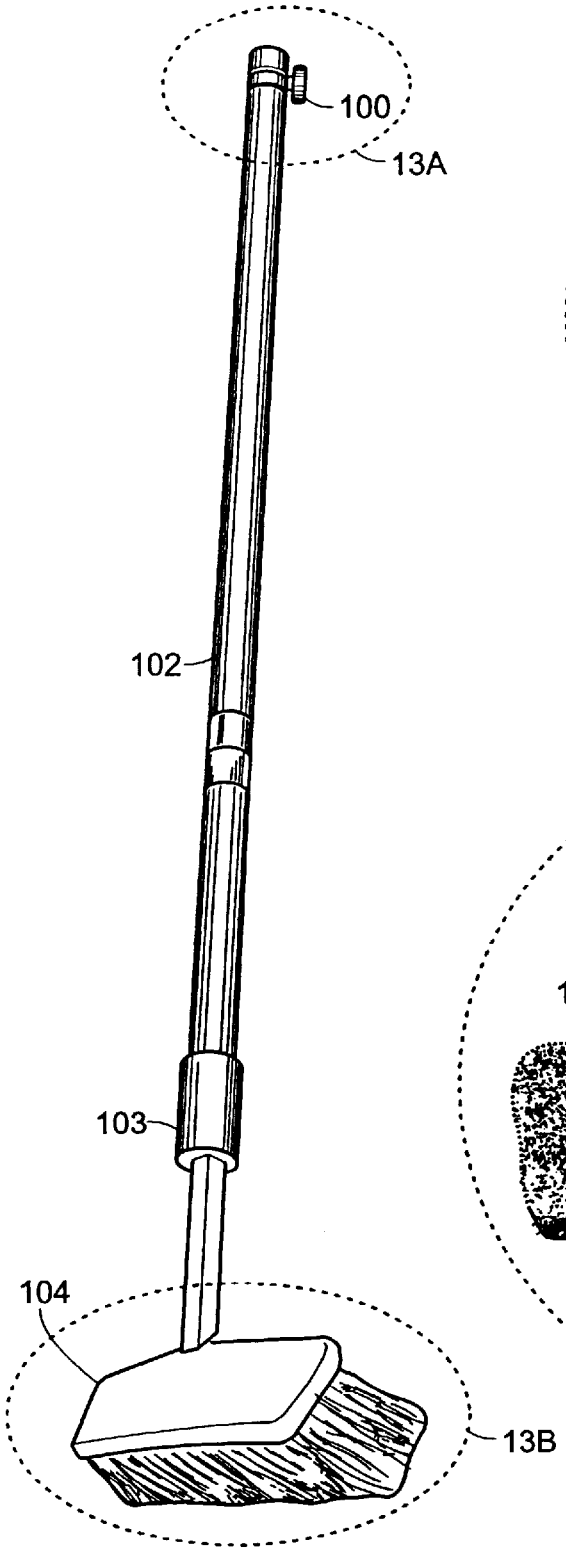
FIG. 13 shows a device combining brush and water technology.
Figure 13A:
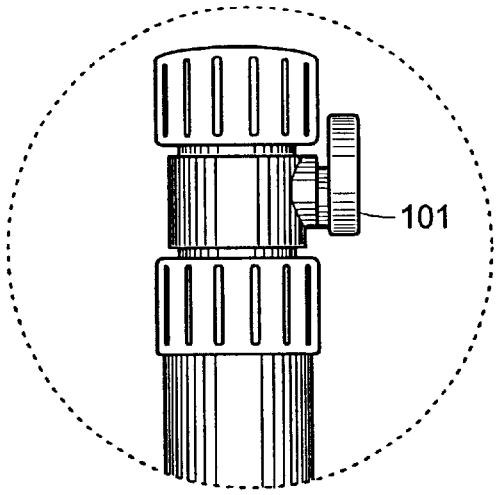
Figure 13B:
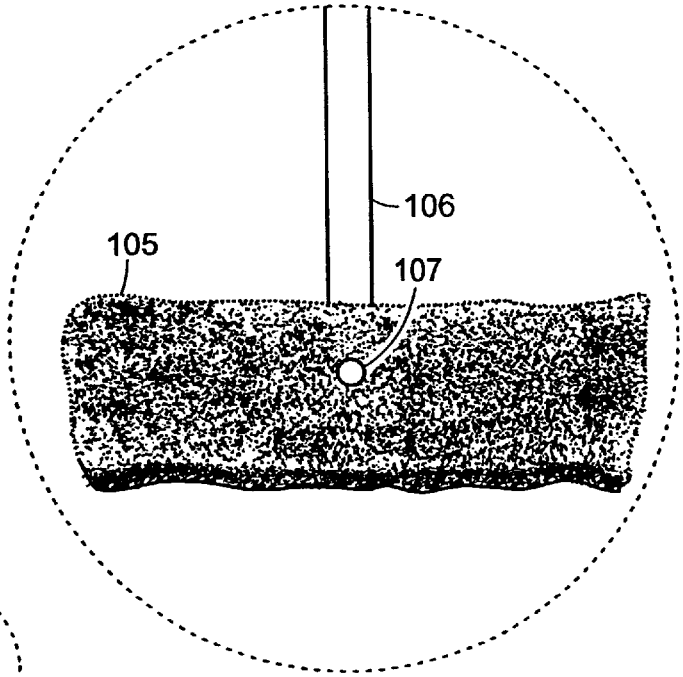

FIG. 10 shows a cost-effective broom head design. Broom head 81, in one embodiment of the invention, can be provided with a configuration wherein the broom head 81 may be approximately 18" Wide×⅞" Thick×4" High. (The height includes a bristle length of 2".) With this design, the broom handle 80 may be attached to the broom head 81 with the tip 86 of the broom handle 80 emerging at the front face of the broom head 81 at 82. A spray bar 83 may be mounted onto the broom head 81 by first positioning a spray bar stem tube 92 inside of hole 91 at end 82 of the broom handle 80, also shown at 87, and pushing the spray bar 83 flush onto the front face of the broom head 81. Screws, nails or other attachment means can be used where indicated to fix the spray bar 83 to the broom head 81. The side view of the spray bar 83 shows the spray bar stem tube 92 and a rubber o-ring type washer 88. When the spray bar stem tube is pushed into the broom handle end hole 91, the o-ring seats on the broom head 82 or end hole 87 and on the stem tube 92 such that water does not leak as it passes from the broom handle 80 to the spray bar 83. An integrated valve and hollow broom handle of the type shown in FIG. 9 are used to supply water to the broom handle 80. The advantage of this design is that it does not require an expensively molded broom head or spray bar in addition, the spray bar can be easily changed for a spray bar with different spray characteristics. The spray bar 83 may include a plurality of spray jets 84 centered to the spray bar 83 and evenly spaced, for example, about 1" apart. The spray jets 84 may each include a hole with a diameter of approximately 3/64" and may be angled at about 35-degrees. The spray jets 84 can be positioned on the bottom or front of the spray bar 83. Alternatively, the broom head 81 can be molded with a simple water channel that supplies water from the handle tip to the broom head top or bottom, which enables the spray bar 83 to be mounted on the top or bottom of the broom head 81, respectively. Optionally, motor technologies, a subject that will be discussed later herein, can be fitted onto or with the spray bar 83.

Figure 16:
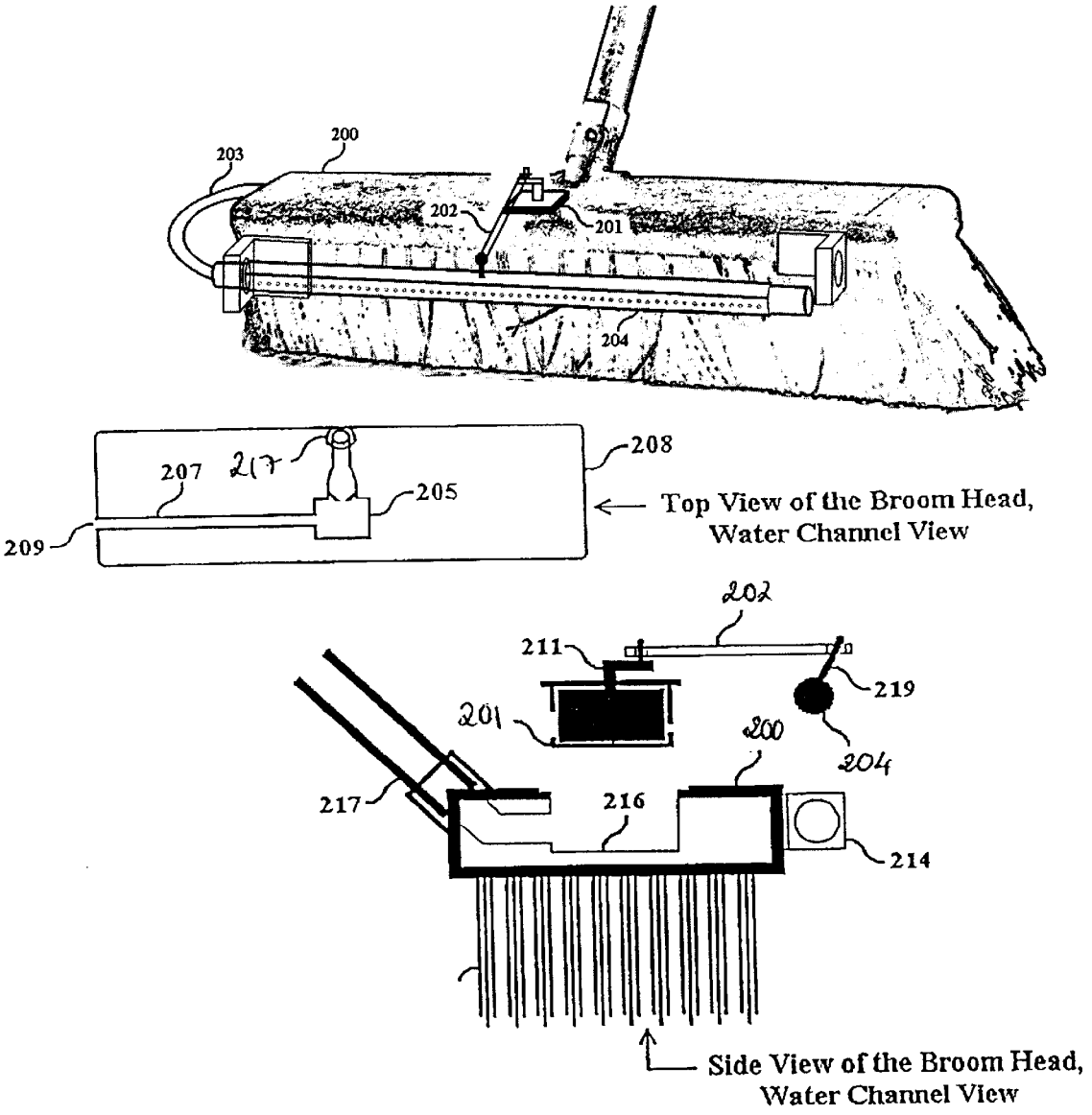
FIG. 16 illustrates in accordance with an embodiment of the present invention a broom having an oscillating spray bar.

In another embodiment, the broom of the present invention can be configured with an oscillating spray bar 204, as illustrated in FIG. 16. The spray bar 204 may be oscillated by a water motor 201, shown in FIG. 16. (The water motor is similar to the motor illustrated by Jerry R. Hayes in U.S. Pat. No. 4,568,023, which is also the subject of the before-mentioned Nelson model 1015 Rainshower® oscillator sprinkler.) The motor 201 can be fitted into cavity 216 of broom head 200, such that it has access to water channels 207. The motor 201 may be activated by water entering the broom head 200 from the broom handle 217 and spraying across the motor's impellers (not shown). The impellers cause motor shaft 211 to rotate, which in turn causes connecting rod 202 to oscillate back and forward. The other end of the rod 202 may be attached to a spray bar lever arm 219. As the rod 202 oscillates, the spray bar 204 rotates in its brackets 214 and causes the water spray attack angle to deviate in an oscillating manner. The spray angle can oscillate be between 10 degrees and 35 degrees.

Alternatively, other angles may be provided for oscillation. Gears or another form of transmission can be used to actuate the spray bar 204 instead of a connecting rod. The motor 201 can be geared such that the desired oscillating frequency can be achieved. The motor 201 can also be designed with a variable speed selection mechanism or a disengage setting. The water from the motor output can be sent through a water channel 207 in the broom head 200, through tube 203, to supply the spray bar 204. The brackets, or other means, holding the spray bar can be designed so that the water motor can effectively and reliably actuate the spray bar.

Over time, the spray jets may become clogged by debris. Debris can originate from the water source or the broom's manufacturing process. Jet clogging can be remedied by providing the broom head with debris port holes 290, such as that shown in FIG. 21. When unplugged, these port holes 290 may allow a user to flush debris out of the broom head's water channels. If debris is stuck in the jet, the user can insert a toothpick, or a similar item, into the jet during the flushing process to dislodge the debris and allow it to flow out through the port holes 290. With the flushing process complete, the user can screw plugs 291 into the debris port holes 290 and use the invention with the operation water spray jets fully restored.

Figure 21:
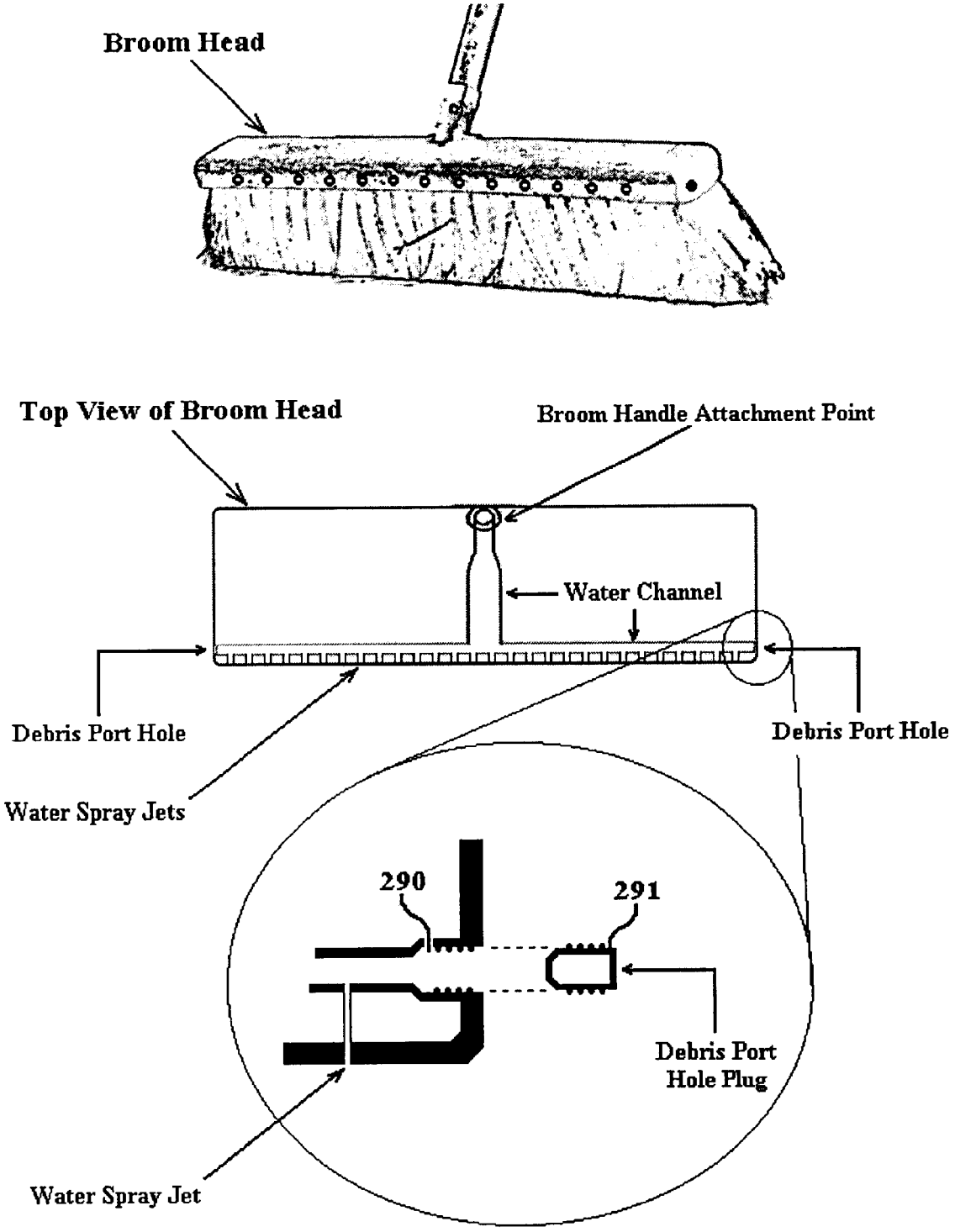
FIG. 21 illustrates a broom head having a port hole for removal of debris from the water spray jets.

The debris port holes 290 should be made of sufficient size to allow water and debris to flow out. The hole size can be between about ¼ inch and about ⅜ inch in diameter. The hole 290 and plug 291 can be threaded such that the plug 291 can be removed and screwed back in the broom head. The plug can be operated by hand, a "Flat" screwdriver, a "Philips" screwdriver, an "Allen" wrench or by other means. When screwed into the broom head, the plug 291 should stop water under pressure from emerging from the debris port holes. The plug 291 illustrated in FIG. 21 is an Allen "Set Screw" with a ⅜–16 thread and ⅜ inches long.

Figure 22:
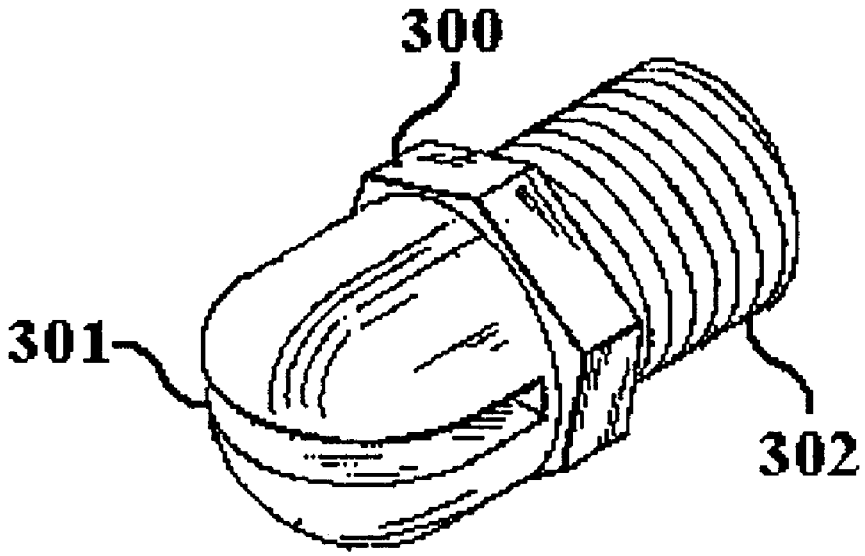
FIG. 22 illustrates a water spray jet for use in accordance with an embodiment of the invention.

The broom of the present invention could be fitted with water spray jets 300 of the type shown in FIG. 22. These jets 300 are formally referred to as nozzles. These nozzles, in one embodiment, can have a thread 302 with a diameter of about ¼ inch, or larger, which can be screwed into the broom head and access the water channel. The use of nozzles eliminates the need for debris port holes. When clogged, the problem nozzles can be removed, cleaned and the system can be flushed. This design also allows the user to change the water spray pattern by changing the type of nozzles used.

Figure 18:
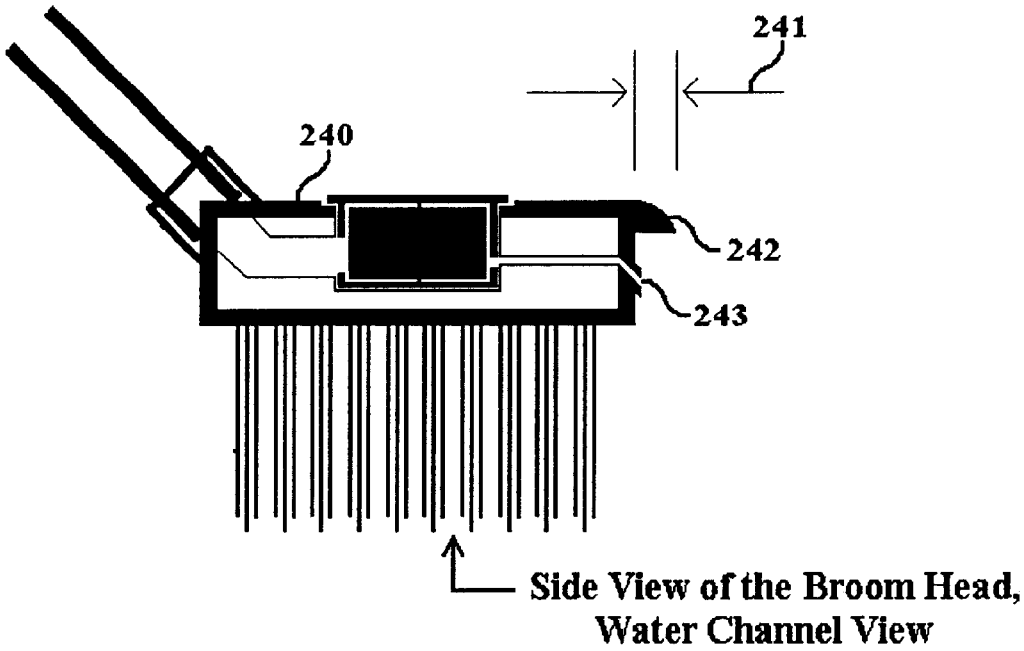
FIG. 18 illustrates a broom having a guard against the water spray jets in accordance with an embodiment of the invention.
Figure 18:
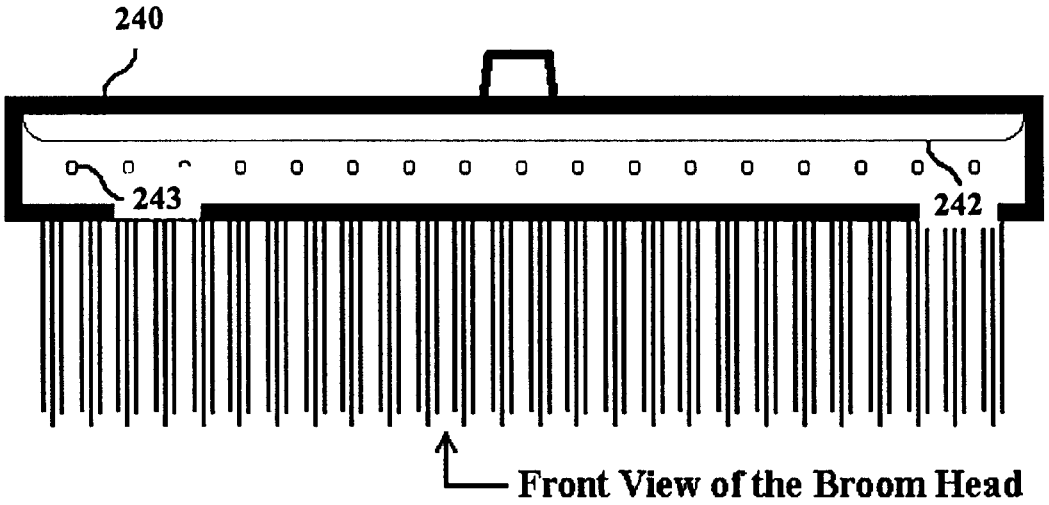

Water spray jets or nozzles mounted to the front of the broom head may require protection from being thrust into vertical surfaces such as walls, curbs, or large rocks. FIG. 18 shows a broom head 240 equipped with a jet guard 242. The jet guard 242 projects out from the broom head 240 at a sufficient distance 241 to protect the spray jets 243 from impact. A front view of the broom head 260 shows the jet guard 242 extended continuously from the left side of the broom head 260 to the right.

Figure 19:
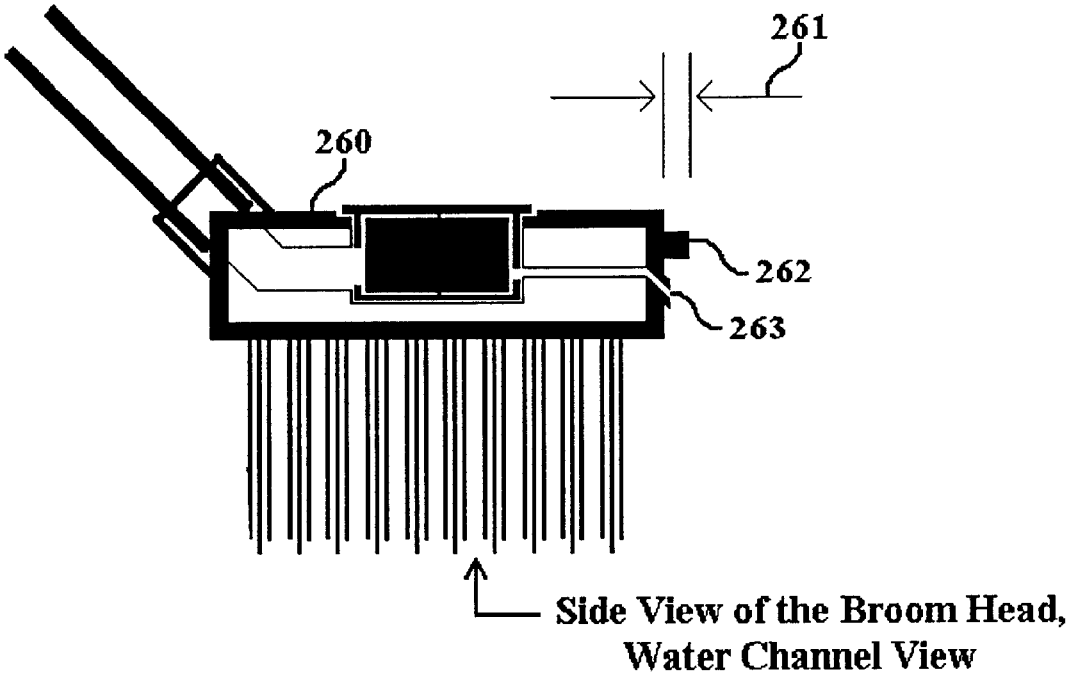
FIG. 19 illustrated in alternative embodiment for the water spray jet guard shown in FIG. 18.
Figure 19:
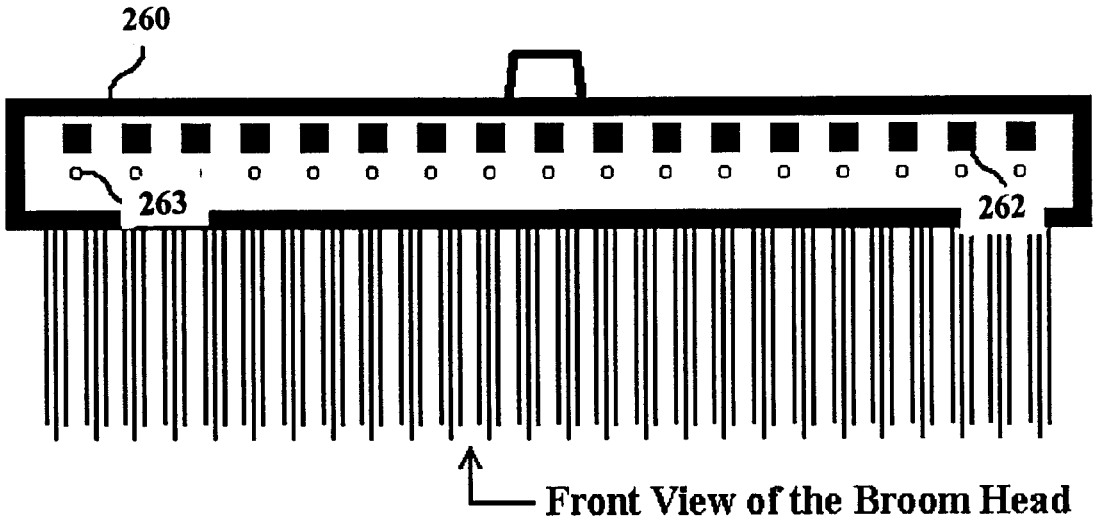
Figure 20A:
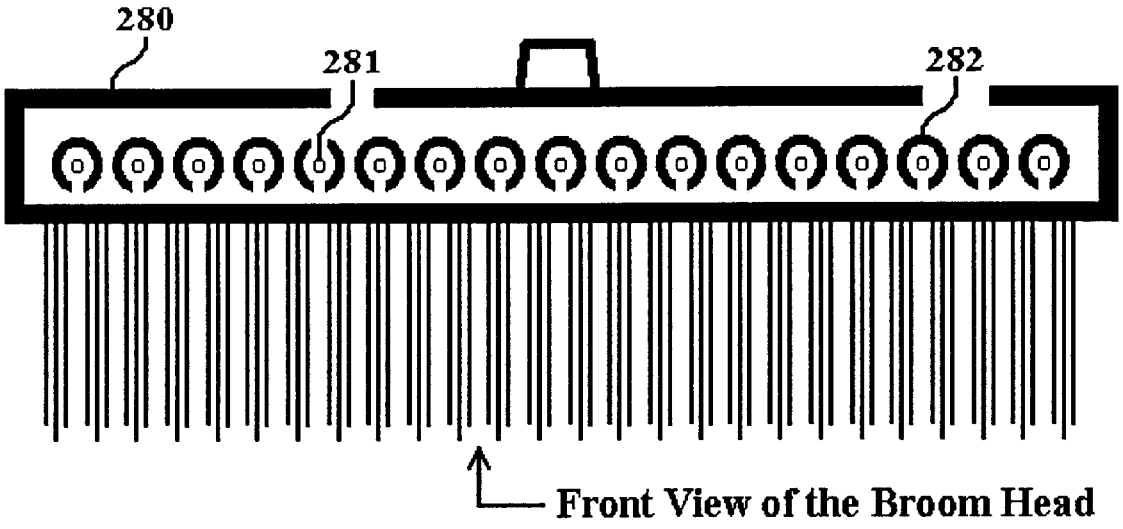
FIGS. 20A–B illustrate embodiments of the broom head having multiple rows of water spray jets.
Figure 23:
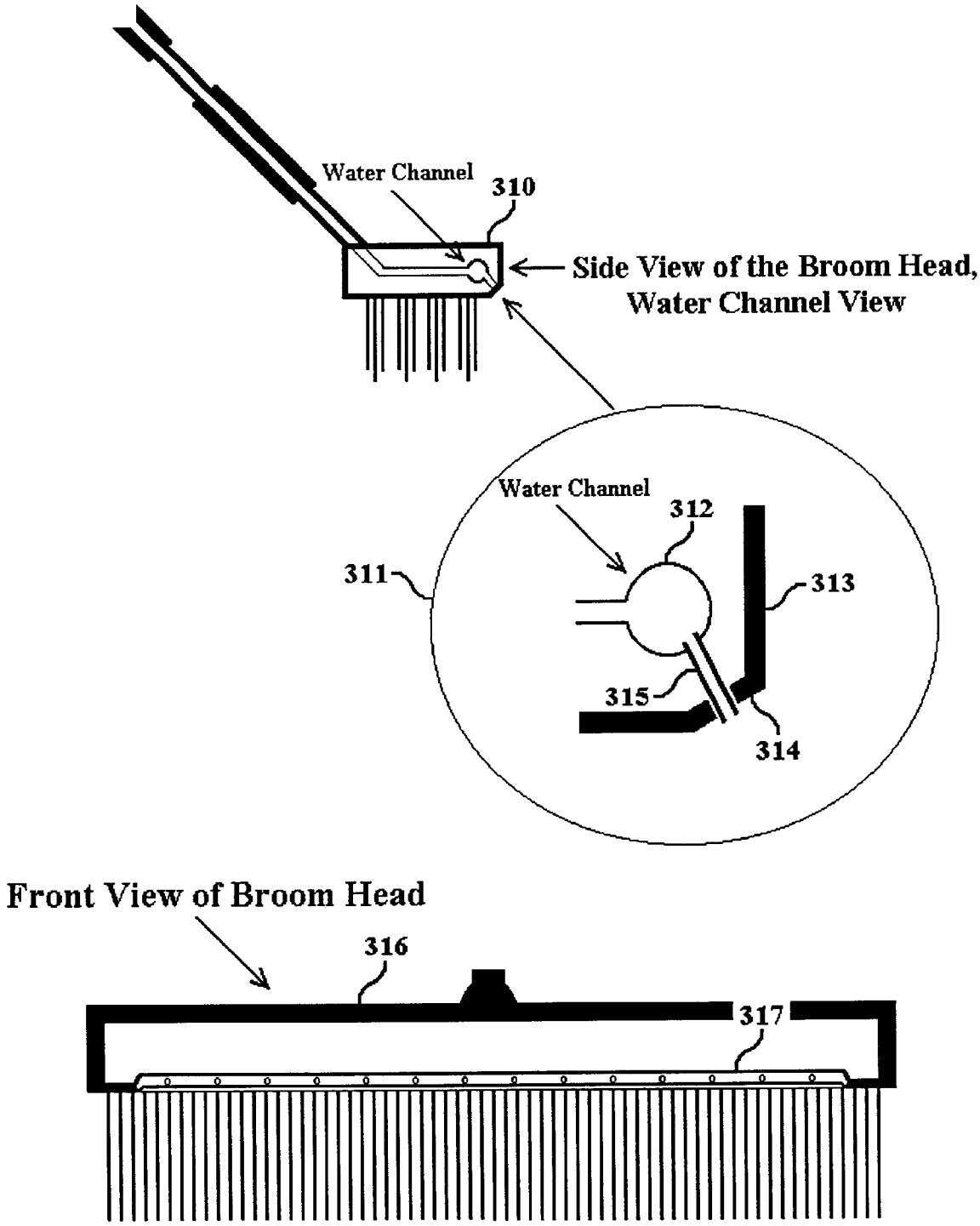
FIG. 23 illustrates the location of the water spray jets in accordance with one embodiment of the present invention.

An alternate embodiment of the jet guard 242 is shown in FIG. 19. The jet guard 262 may be composed of a series of guards 262 placed above the spray jets 263 on the broom head 260. The guards 262 can be made into different shapes and can be optionally positioned on the sides or bottom of the spray jets 263. FIG. 20A shows still another jet guard design. These guards 282 surround or substantially surround the spray jets 281 on the broom head 280. Another alternative is to design the broom head such that the spray jets recess into the broom head. Still another design alternative is to position the spray jets or nozzles 315 on a sloped or angled surface 314 as shown in FIG. 23.

Figure 17:
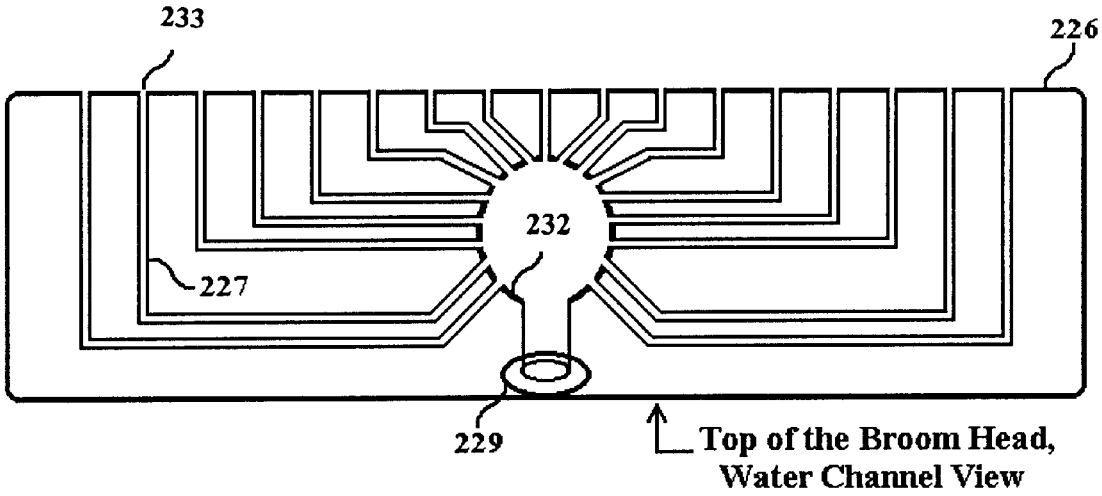
FIG. 17 illustrates an embodiment of the broom designed to include water pulsing spray jets.
Figure 17:
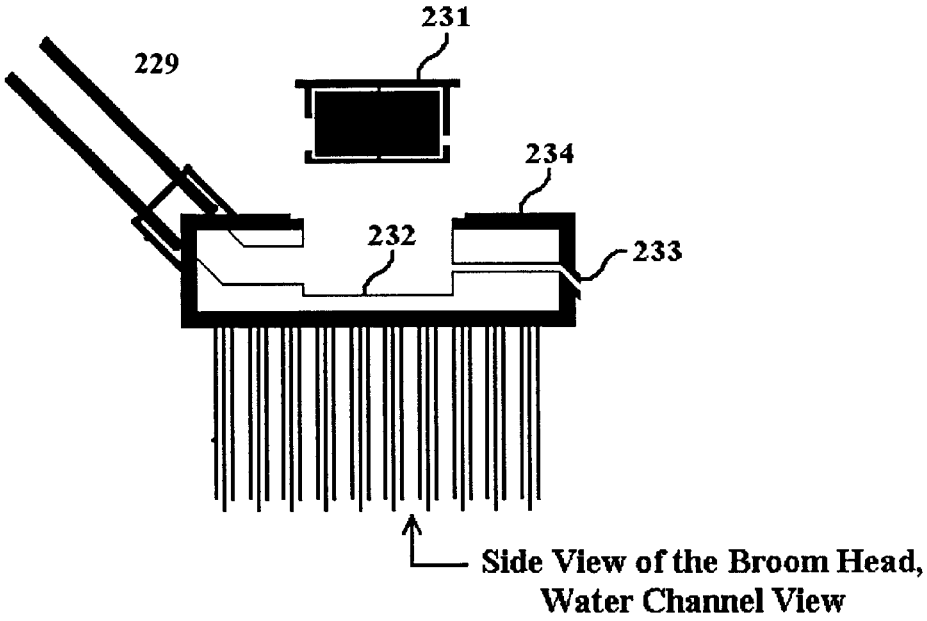

The broom of the present invention can have a spray bar 229 with water pulsing spray jets 233. Water pulsing can be achieved by fitting the invention with a water pulsing motor 231, as shown in FIG. 17. The pulsing motor 231 can be fitted into a cavity 232 in the broom head 234. The motor 231 receives water from the broom handle 229 and pulses the water from the cavity 232 through the various water channels 227 to the water spray jets 233. The motor 231 can be configured to pulse water in various patterns, sequences and frequencies. The spray jets 233 can be pulsed individually, in groups and simultaneously. The water channels 227 can be grouped or arranged differently. A user activated control can be made available to select the pattern, sequence and frequency of pulses. Additionally, the user may have a continuous spray option. The pulse pattern and sequence can be used to steer surface debris in a desired direction.

An example of a water pulsing motor technology is the Teledyne Water Pik Shower Massage® showerhead. This showerhead technology is embodied in U.S. Pat. Nos. 5,316,216, 4,190,207, and 3,801,019. The Shower Massage's pulsing motor operates three groups of six water spray jets with a 3/32 inch jet hole diameter. The motor's water turbine activates each jet group separately and in sequence, and repeats the sequence at a user set frequency. During operation, the pulsing motor generates extremely powerful and forceful pulses of water. These characteristics are very beneficial to the broom invention herein. When adapted for the invention, this technology produces a broom with superior sweeping and cleaning capabilities.

It should be noted that the operation of the pulse motor also causes the broom head and bristles to vibrate. As the bristles vibrate, their abrasive characteristics on the floor surface increase, which thus increases the broom's cleaning effectiveness. Optionally, the invention could be equipped with a water driven vibration motor.

Figure 20B:
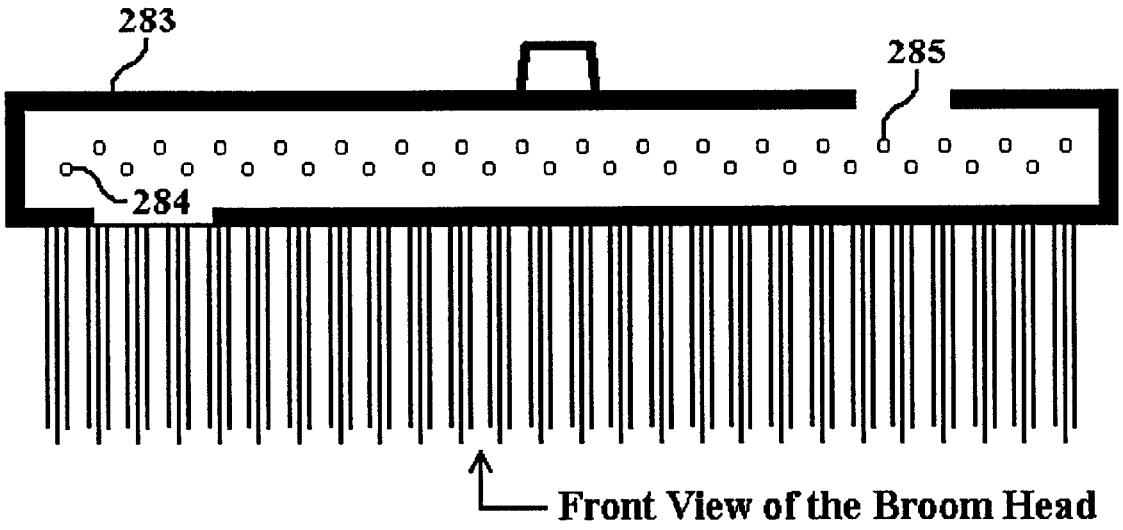

It may be necessary and desirable to have more than one row of water spray jets. The broom head 283 in FIG. 20B shows such a configuration. The spray jets in each row 284 and 285 can have different functions independent of the spray jets in the other row, including those functions as described herein.

Figure 24:
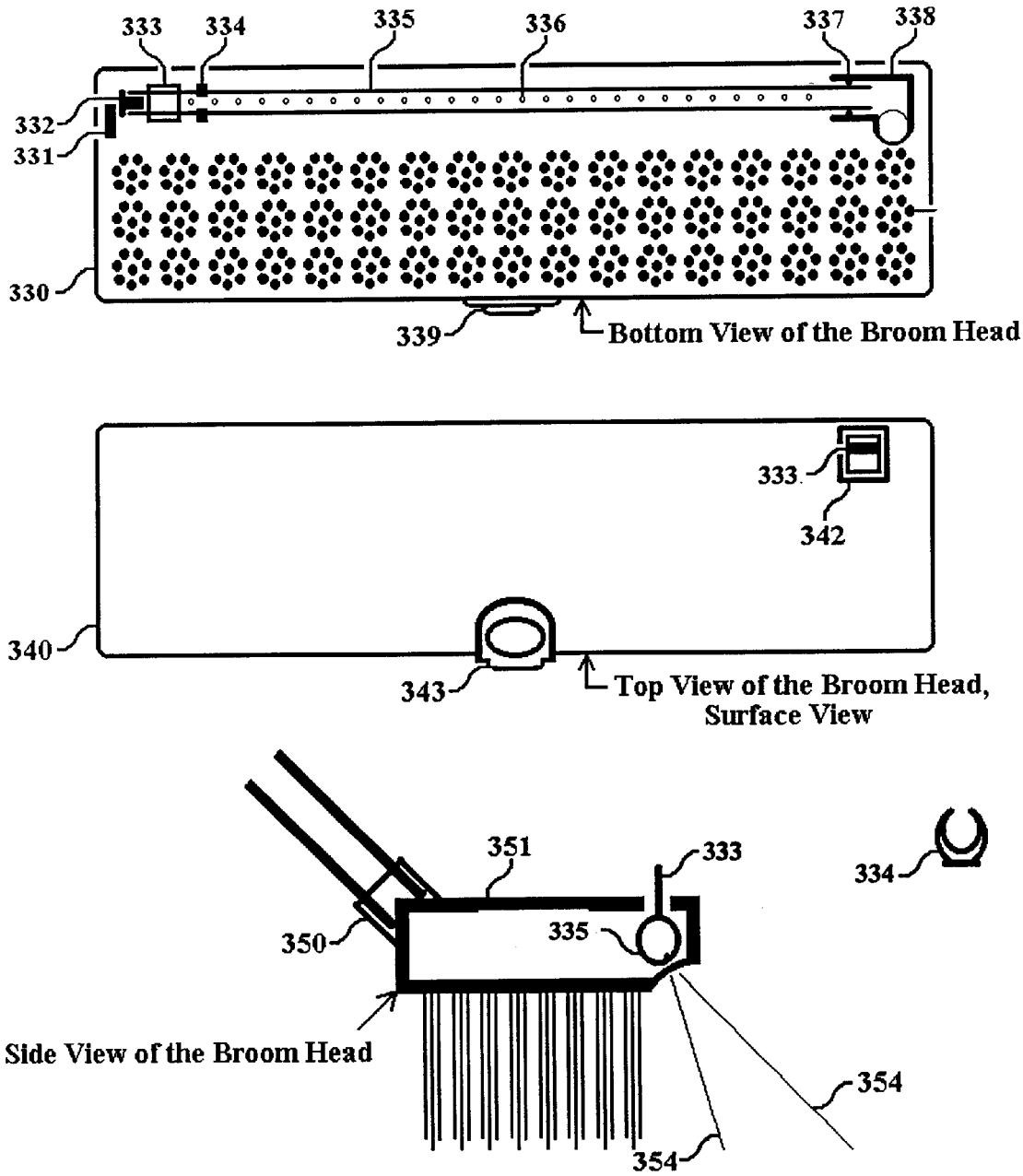
FIG. 24 illustrates in accordance with an embodiment of the invention a broom head having a manually adjustable spray bar.

FIG. 24 shows a broom head 330 with a manually adjustable spray bar 335. The spray bar 335 may be held onto the broom head 330 by a fixture 338 and a c-clamp 334. The fixture 338 may be connected to the broom head's water channel and provides water to the spray bar 335 from the broom handle connected at 343. An O-Ring 337 can provide a water tight seal between the spray bar 335 and the fixture 338. The spray bar 335 is fitted with a lever arm 333 that emerges through a hole 342 in the broom head 330. The lever arm 333 may rotate the spray bar 333 such that the water jets' 336 angle of attack 354 is altered. The spray bar 335 may also be provided with a debris port hole plug 332. A stop block 331 can also provided to prevent water pressure from ejecting the spray bar 335 out of the fixture 338. The spray bar 335 can have a plurality of spray jets with a hole diameter of about 3/64 inch and spaced about 1 inch apart. The lever arm 352 can adjust the angle of attack 354, in one embodiment, from 10-degrees to 40-degrees. Alternatively, the invention can use other angles.

In this design, the spray bar 335 can be extremely easy to install and remove from the broom head 330. To install, the user or manufacturer may position an end of the spray bar 335 opposite the lever arm 333 into the fixture 338. The installation may be completed by snapping the remaining end of the spray bar 335 into clamp 334, while positioning the lever arm 333 to emerge through the hole at 342. Reversing these steps will remove the spray bar 335.

Figure 25:
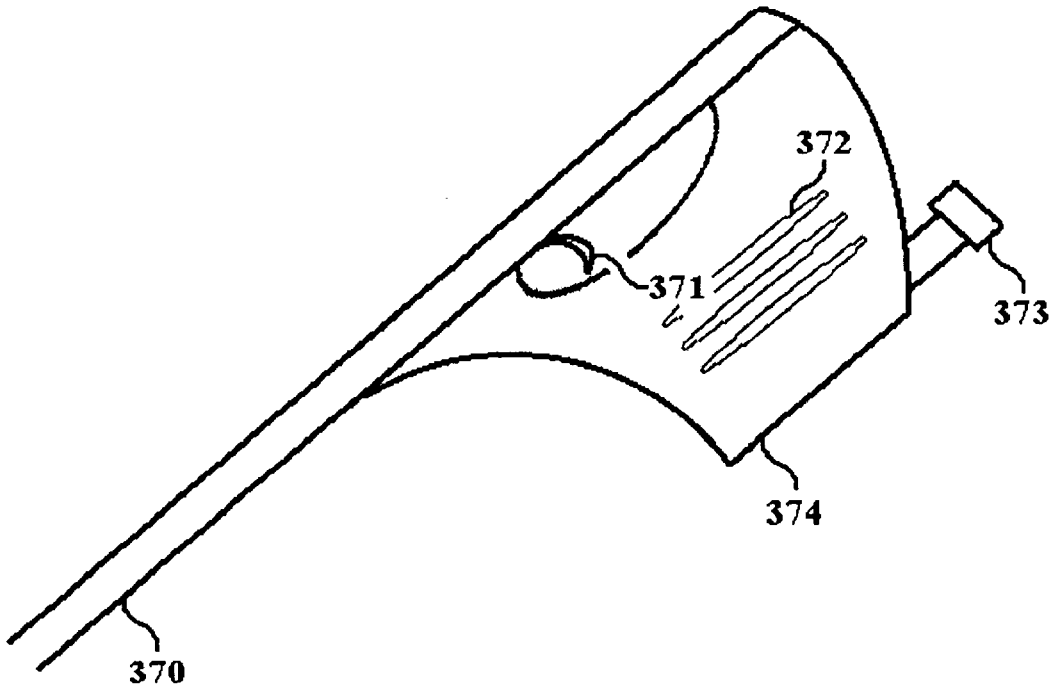
FIG. 25 illustrates a engine-driven water pump for use in accordance with an embodiment of the present invention.
Figure 25:
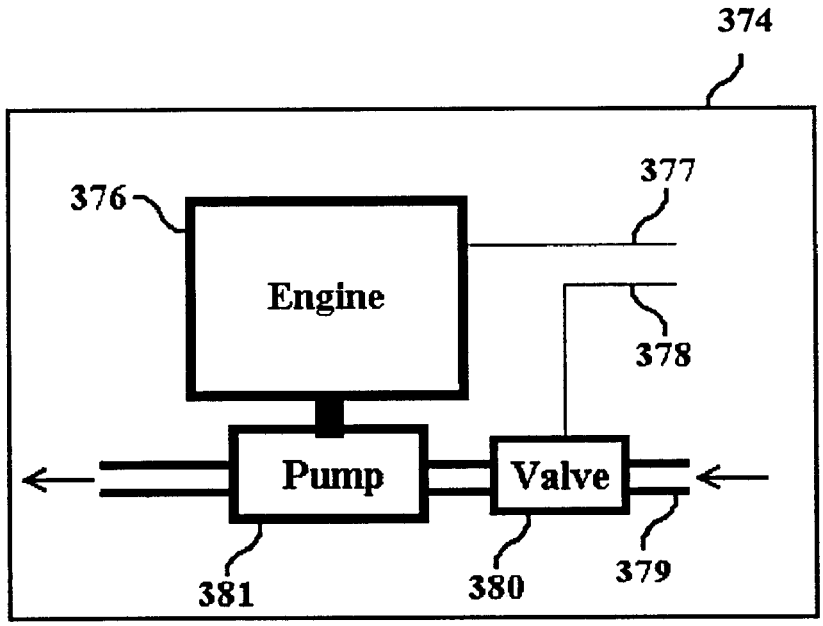

If supplied by inadequate water pressure, the invention can be fitted with an engine driven water pump. FIG. 25 shows an engine 376, pump 381, and valve 380 housed in a handle assembly 374. A water hose may be attached at 373 and supplies water to valve 380. A spring-loaded trigger 371 or other manually operated lever controls the engine 376 throttle and valve 380 via 377 and 378, respectively. When the trigger 371 is engaged, water flows through the valve 380 to the pump 381 where an accelerated engine generates high water pressure to the broom handle 370. When disengaged, the water flow is stopped by the valve 380 and the engine 376 is returned to idle. Alternatively, the engine throttle can be regulated by a water pressure sensor, set at a constant speed, or regulated in some other manor. The engine can be similar to the Ryobi 31 cc engine supplied to the Model 790R "EZ" 2 Cycle Trimmer/Brush Cutter. The water pump and valve are commercially available and are well known in the art. The assembly 374 can be positioned elsewhere on the broom handle or on the broom head. Alternatively, an electric motor can be used instead of a gasoline engine. Or, alternatively, the engine or electric motor and pump can be fitted to a user "back-pack" with a connecting hose and controls mounted to the broom handle. The valve can be optionally positioned on the broom handle or the "back-pack" assembly.

While the invention has been disclosed in connection with the preferred embodiments shown and described in detail, various modifications and improvements thereon will become readily apparent to those skilled in the art. Accordingly, the spirit and scope of the present invention is to be limited only by the following claims.

What is claimed is:

1. A device for sweeping across a substantially horizontal surface, the device comprising:

a push broom having a broom head for sweeping across the horizontal surface and a handle attached thereto for pushing the broom head, said broom head having a cavity;

a spray bar disposed on and in front of the broom head for directionally discharging a fluid in front of and away from the broom head and onto the horizontal surface across which the broom head is to be swept; and a mechanism for actuating the spray bar in an oscillating manner, so as to permit the fluid discharging from the spray bar to move back and forth along an arcuate path, said mechanism including a fluid motor fitted in said cavity, wherein said fluid activates said fluid motor and in turn activates the spray bar in said oscillating manner along said arcuate path.

2. A device as set forth in claim 1, wherein the spray bar includes a plurality of spray jets for individually discharging a stream of fluid from the spray bar.

3. A method of cleaning a substantially horizontal surface, the method comprising:

providing a push broom having a broom head, a handle attached to the broom head, and a cavity located on the broom head;

coupling to the front of the broom head a spray bar capable of oscillating back and forth along an arcuate path for directionally discharging a fluid in front of and away from the broom head and onto the horizontal surface across which the broom head is to be swept;

fitting a mechanism for activating the spray bar in an oscillating manner so as to permit the fluid discharging from the spray bar to move back and forth along an arcuate path, said mechanism including a fluid motor fitted in said cavity;

positioning the broom head behind debris to be swept;

generating the fluid discharge through the spray bar, wherein said fluid activates said fluid motor and in turn activates the spray bar in said oscillating manner along said arcuate path;

pushing the handle so as to move the broom head in a sweeping manner across the horizontal surface, such that the debris is moved therealong; and discontinuing the fluid discharge through the spray bar.

* * * * *